US011310582B2

(12) United States Patent
Li et al.

(10) Patent No.: US 11,310,582 B2
(45) Date of Patent: *Apr. 19, 2022

(54) LOUDSPEAKER APPARATUS

(71) Applicant: SHENZHEN SHOKZ CO., LTD., Guangdong (CN)

(72) Inventors: Chaowu Li, Shenzhen (CN); Yongjian Li, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/139,076

(22) Filed: Dec. 31, 2020

(65) Prior Publication Data

US 2021/0127193 A1 Apr. 29, 2021

Related U.S. Application Data

(63) Continuation of application No. PCT/CN2019/102393, filed on Aug. 24, 2019.

(30) Foreign Application Priority Data

Jan. 5, 2019 (CN) ..... 201910009927.4

(51) Int. Cl.
*H04R 1/10* (2006.01)
*H04R 1/02* (2006.01)
(Continued)

(52) U.S. Cl.
CPC ..... *H04R 1/105* (2013.01); *H04R 1/023* (2013.01); *H04R 1/026* (2013.01); *H04R 1/1008* (2013.01);
(Continued)

(58) Field of Classification Search
CPC ..... H04R 1/105; H04R 1/023; H04R 1/026; H04R 1/1008; H04R 1/1041;
(Continued)

(56) References Cited

U.S. PATENT DOCUMENTS 5,761,298 A * 6/1998 Davis ..... H04M 1/05 379/430
7,539,525 B2 * 5/2009 Kim ..... H04M 1/05 379/433.13
(Continued)

FOREIGN PATENT DOCUMENTS

CN 203827497 U 9/2014
CN 204465795 U 7/2015
(Continued)

OTHER PUBLICATIONS

International Search Report in PCT/CN2019/102397 dated Oct. 29, 2019, 6 pages.
(Continued)

*Primary Examiner* — Oyesola C Ojo
(74) *Attorney, Agent, or Firm* — Metis IP LLC

(57) ABSTRACT

The present disclosure discloses a loudspeaker apparatus. The loudspeaker apparatus may include an ear hook including a first plug end and a second plug end, a core housing for accommodating an earphone core, and a circuit housing for accommodating a control circuit or a battery. The ear hook may be surrounded by a protective sleeve which is made of an elastic waterproof material. The core housing may be fixed to the first plug end and elastically abutted against the protective sleeve. The core housing may include a housing panel facing human body and a housing back panel opposite to the housing panel. When the vibration frequencies of the housing panel and the housing back panel is within a range of 2000 Hz to 3000 Hz, an absolute value of a difference
(Continued)

between the first phase and the second phase may be less than 60 degrees.

20 Claims, 14 Drawing Sheets

(51) Int. Cl.
*H04R 31/00* (2006.01)
*H04R 9/02* (2006.01)
*H04R 1/44* (2006.01)

(52) U.S. Cl.
CPC ..... *H04R 1/1041* (2013.01); *H04R 1/1058* (2013.01); *H04R 1/1091* (2013.01); *H04R 1/44* (2013.01); *H04R 9/025* (2013.01); *H04R 31/00* (2013.01); *H04R 1/1016* (2013.01); *H04R 1/1025* (2013.01); *H04R 2201/10* (2013.01); *H04R 2460/13* (2013.01)

(58) Field of Classification Search
CPC ..... H04R 1/1058; H04R 1/1091; H04R 1/44; H04R 9/025; H04R 31/00; H04R 1/1016; H04R 1/1025; H04R 2201/10; H04R 2460/13; H04R 1/1066; H04R 1/347; H04R 5/0335; H04R 5/033; H04R 1/06; H04R 11/02; H04R 2225/63
See application file for complete search history.

(56) References Cited

U.S. PATENT DOCUMENTS

| | | | | |
|---|---|---|---|---|
| 8,654,987 | B2 * | 2/2014 | Palma | H04R 1/1041 381/74 |
| 9,049,515 | B2 * | 6/2015 | Clow | H04R 1/1091 |
| 2002/0102005 | A1 * | 8/2002 | Lin | H04R 1/1066 381/381 |
| 2009/0154755 | A1 * | 6/2009 | Yamagishi | H04R 1/345 381/382 |
| 2009/0262964 | A1 * | 10/2009 | Havenith | H04R 25/505 381/314 |
| 2011/0110553 | A1 * | 5/2011 | Logan | H04R 1/1058 381/380 |
| 2013/0163791 | A1 | 6/2013 | Qi et al. | |
| 2016/0329041 | A1 | 11/2016 | Qi et al. | |
| 2017/0257692 | A1 * | 9/2017 | Yang | H04R 1/1016 |
| 2017/0318369 | A1 | 11/2017 | Wang | |
| 2020/0336824 | A1 | 10/2020 | Zheng et al. | |

FOREIGN PATENT DOCUMENTS

| | | | | | |
|---|---|---|---|---|---|
| CN | 107484054 | | * | 12/2017 | H04R 1/1083 |
| CN | 107484054 | A | | 12/2017 | |
| CN | 207010974 | U | | 2/2018 | |
| CN | 207039848 | U | | 2/2018 | |
| CN | 207039849 | U | | 2/2018 | |
| CN | 207039851 | U | | 2/2018 | |
| CN | 207070282 | U | | 3/2018 | |
| CN | 207783068 | U | | 8/2018 | |
| CN | 109547905 | A | | 3/2019 | |
| CN | 109660901 | A | | 4/2019 | |
| CN | 109714687 | A | | 5/2019 | |
| CN | 109769167 | A | | 5/2019 | |
| CN | 109788386 | A | | 5/2019 | |
| CN | 209089198 | U | | 7/2019 | |
| CN | 209184800 | U | | 7/2019 | |
| CN | 209184801 | U | | 7/2019 | |
| CN | 209267804 | U | | 8/2019 | |
| CN | 209358729 | U | | 9/2019 | |
| CN | 210536887 | U | * | 5/2020 | |
| JP | 02056121 | A | * | 2/1990 | H04B 1/38 |
| WO | 2018175192 | A1 | | 9/2018 | |

OTHER PUBLICATIONS

International Search Report in PCT/CN2019/102399 dated Oct. 30, 2019, 7 pages.
International Search Report in PCT/CN2019/102392 dated Nov. 21, 2019, 7 pages.
International Search Report in PCT/CN2019/102400 dated Nov. 22, 2019, 8 pages.
International Search Report in PCT/CN2019/102393 dated Nov. 25, 2019, 7 pages.

* cited by examiner

2700

2900

LOUDSPEAKER APPARATUS

CROSS-REFERENCE TO RELATED APPLICATIONS

This application is a Continuation of International Application No. PCT/CN2019/102393 filed on Aug. 24, 2019, which claims priority of Chinese Patent Application No. 201910009927.4, filed on Jan. 5, 2019, the entire contents of each of which are incorporated herein by reference.

TECHNICAL FIELD

The present disclosure relates to a loudspeaker apparatus, and in particular, to a loudspeaker apparatus with a waterproof function.

BACKGROUND

Generally, people can hear the sound because air transmits vibration to the eardrum through the external ear canal, and the vibration formed by the eardrum drives the human auditory nerve, thereby perceiving the sound. At present, earphones are widely used in people's lives. For example, users can use earphones to play music, answer calls, etc. Earphones have become an important item in people's daily life. Ordinary earphones can no longer meet the normal use of users in some special scenes (e.g., swimming, rainy days, etc.). Thus, earphones with waterproof function and better sound quality are more popular with consumers. Therefore, it may be necessary to provide a loudspeaker apparatus with waterproof function and easy to produce and assemble.

SUMMARY

The embodiments of the present disclosure provide a loudspeaker apparatus. The loudspeaker apparatus may include an ear hook, a core housing, and a circuit housing. The ear hook may include a first plug end and a second plug end. The ear hook may be surrounded by a protective sleeve. The protective sleeve may be made of an elastic waterproof material. The core housing may be used for accommodating an earphone core. The core housing may be fixed to the first plug end and elastically abutted against the protective sleeve. The core housing may include a housing panel facing human body and a housing back panel opposite to the housing panel. The vibration of the earphone core may drive the housing panel and the housing back panel to vibrate. The vibration of the housing panel may have a first phase. The vibration of the housing back panel may have a second phase. When the vibration frequencies of the housing panel and the housing back panel is within a range of 2000 Hz to 3000 Hz, an absolute value of a difference between the first phase and the second phase may be less than 60 degrees. The circuit housing may be used for accommodating a control circuit or a battery. The circuit housing may be fixed to the second plug end. The control circuit or the battery may drive the earphone core to vibrate to generate a sound.

In some embodiments, the ear hook may include an elastic metal wire, a wire, and a fixed sleeve. The fixed sleeve may fix the wire on the elastic metal wire. The protective sleeve may be formed, by injection molding, on periphery of the elastic metal wire, the wire, the fixed sleeve, the first plug end, and the second plug end.

In some embodiments, the first plug end and the second plug end may be formed, by injection molding, at both ends of the elastic metal wire respectively. The first plug end and the second plug end may be arranged with a first wiring channel and a second wiring channel respectively. The wire may extend along the first wiring channel and the second wiring channel.

In some embodiments, the wire may pass through the first wiring channel and the second wiring channel.

In some embodiments, the first wiring channel may include a first wiring groove and a first wiring hole connecting the first wiring groove and an outer end surface of the first plug end. The wire may extend along the first wiring groove and the first wiring hole and is exposed on the outer end surface of the first plug end. The second wiring channel may include a second wiring groove and a second wiring hole connecting the second wiring groove and the outer end surface of the first plug end. The wire may extend along the second wiring groove and the second wiring hole and may be exposed on the outer end surface of the second plug end.

In some embodiments, the ear hook may include at least two fixed sleeves spaced apart along the elastic metal wire.

In some embodiments, the core housing may be arranged with a first socket connecting with an outer end surface of the core housing. A stopping block may be arranged on an inner sidewall of the first socket. The first socket may be connected to the first plug end.

In some embodiments, the first plug end may include an inserting portion and two elastic hooks. The inserting portion may be at least partially inserted into the first socket and abutting against an outer side surface of the stopping block. The two elastic hooks may be arranged on a side of the inserting portion facing inside of the core housing. The two elastic hooks may be brought together under action of external thrust and the stopping block. After passing through the stopping block, the two elastic hooks may be elastically restored to be stuck on an inner surface of the stopping block to realize the fixation of the core housing and the first plug end.

In some embodiments, the inserting portion may be partially inserted into the first socket. An exposed part of the inserting portion may be arranged in a stepped manner to form an annular table surface spaced apart from the outer end surface of the core housing.

In some embodiments, the protective sleeve may further extend to a side of the annular table surface facing the outer end surface of the core housing. When the core housing and the first plug end are fixed, the protective sleeve may elastically abut against the core housing to realize sealing.

In some embodiments, the loudspeaker apparatus may further include a fastener. The circuit housing may be arranged with a second socket. The second plug end may be at least partially inserted into the second socket and connected to the second socket by the fastener.

In some embodiments, the second plug end may be arranged with a slot perpendicular to an inserting direction of the second socket. A through hole corresponding to a position of the slot may be arranged on a first sidewall of the circuit housing. The fastener may include two parallel pins and a connecting portion for connecting the pins. The pins may be inserted into the slot from outside of the circuit housing through the through hole to realize the plug and fixation of the circuit housing and the second plug end.

In some embodiments, the ear hook may further include a housing sheath integrally formed with the protective sleeve. The housing sheath may be wrapped around periphery of the circuit housing.

In some embodiments, the vibration of the housing panel may have a first amplitude. The vibration of the housing back panel may have a second amplitude. A ratio of the first amplitude to the second amplitude may be within a range of 0.5 to 1.5.

In some embodiments, the vibration of the housing panel may generate a first leaked sound wave. The vibration of the housing back panel may generate a second leaked sound wave. The first leaked sound wave and the second leaked sound wave may be superimposed on each other, which reduces an amplitude of the first leaked sound wave.

In some embodiments, the housing panel and other parts of the housing may be connected by at least one of glue, clamping, welding, or threaded connecting.

In some embodiments, the housing panel and the housing back panel may be made of fiber reinforced plastic materials.

In some embodiments, the earphone core may further include a magnetic circuit component generating a first magnetic field. The magnetic circuit component may include a first magnetic unit configured to generate a second magnetic field, a first magnetically conductive unit, and at least one second magnetic unit. The at least one second magnetic unit may surround the first magnetic unit and form a magnetic gap with the first magnetic unit. A magnetic field strength of the first magnetic field in the magnetic gap may be greater than a magnetic field strength of the second magnetic field in the magnetic gap.

In some embodiments, the magnetic circuit component may further include a second magnetically conductive unit, and at least one third magnetic unit being connected to the second magnetically conductive unit and the at least one second magnetic unit.

In some embodiments, the magnetic circuit component may further include at least one fourth magnetic unit being located below the magnetic gap and connected to the first magnetic unit and the second magnetically conductive unit.

In some embodiments, the magnetic circuit component may further include at least one fifth magnetic unit being connected to an upper surface of the first magnetically conductive unit.

In some embodiments, the magnetic circuit component may further include a third magnetically conductive unit being connected to an upper surface of the fifth magnetic unit. The third magnetically conductive unit may be configured to suppress a leakage of a field strength of the first magnetic field.

In some embodiments, the first magnetically conductive unit may be connected to the upper surface of the first magnetic unit. The second magnetically conductive unit may include a bottom plate and a sidewall. The first magnetic unit may be connected to the bottom plate of the second magnetically conductive unit.

In some embodiments, the magnetic circuit component may further include at least one electrically conductive unit may be connected to at least one unit of the first magnetic unit, the first magnetically conductive unit, or the second magnetically conductive unit.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1:
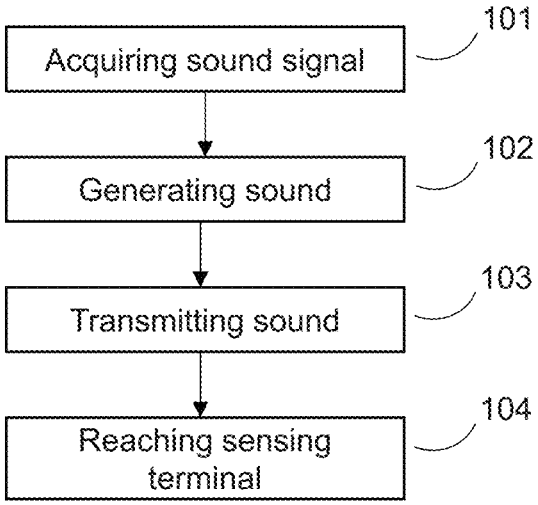
FIG. 1 is a flowchart illustrating an exemplary process for generating auditory sense through a loudspeaker apparatus according to some embodiments of the present disclosure.

In the following detailed description, numerous specific details are set forth by way of examples in order to provide a thorough understanding of the relevant disclosure. Obviously, drawings described below are only some examples or embodiments of the present disclosure. Those skilled in the art, without further creative efforts, may apply the present disclosure to other similar scenarios according to these drawings. It should be understood that the purposes of these illustrated embodiments are only provided to those skilled in the art to practice the application, and not intended to limit the scope of the present disclosure. Unless obviously obtained from the context or the context illustrates otherwise, the same numeral in the drawings refers to the same structure or operation.

As used in the disclosure and the appended claims, the singular forms "a," "an," and "the" may include plural referents unless the content clearly dictates otherwise. In general, the terms "comprise" and "include" merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment;" the term "another embodiment" means "at least one other embodiment." Related definitions of other terms will be given in the description below. In the following, without loss of generality, the description of "player", "loud speaking component", "loudspeaker device" or "loudspeaker component" may be used when describing a related technology of sound conduction in the present disclosure. This description is only a form of sound conduction application. For those skilled in the art, "player", "playing device", "loud speaking component", "loudspeaker device" or "hearing aid" may also be replaced with other similar words. In fact, various implementations in the present disclosure may be easily applied to other non-speaker component hearing devices. For example, for those skilled in the art, after understanding the basic principle of the loud speaking component, it may be possible to make various modifications and changes in the form and details of the specific methods and operations of implementing the loud speaking component without departing from the principles. In particular, an environmental sound collection and processing function may be added to the loud speaking component to implement the function of a hearing aid. For example, in the case of using a bone conduction loud speaking component, adding a microphone that may pick up the sound of a user/wearer's surrounding environment, processing the sound using a certain algorithm and transmit the processed sound (or generated electrical signal) to a loud speaking component of eyeglasses. That is, the bone conduction loud speaking component may be modified to include the function of collecting the environmental sound, and after a certain signal processing, the sound may be transmitted to the user/wearer via the bone conduction loud speaking component, thereby implementing the function of the bone conductive hearing aid. As an example, the algorithm mentioned herein may include noise cancellation, automatic gain control, acoustic feedback suppression, wide dynamic range compression, active environment recognition, active noise reduction, directional processing, tinnitus processing, multi-channel wide dynamic range compression, active howling suppression, volume control, or the like, or any combination thereof.

FIG. 1 is a flowchart illustrating an exemplary process for generating auditory sense through a loudspeaker apparatus according to some embodiments of the present disclosure. The loudspeaker apparatus may transfer sound to an auditory system through bone conduction or air conduction by a built-in loudspeaker, thereby generating an auditory sense. As shown in FIG. 1, the process for generating the auditory sense through the loudspeaker apparatus may include operations 101-104.

In 101, the loudspeaker apparatus may acquire or generate a signal (also referred to as a "sound signal") containing sound information. In some embodiments, the sound information may refer to a video file or an audio file with a specific data format. The sound information may refer to data or files that may be converted to be sound through specific approaches. In some embodiments, the signal containing the sound information may be obtained from a storage unit of a loudspeaker apparatus itself. In some embodiments, the signal containing the sound information may be obtained from an information generation system, a storage system, or a delivery system other than the loudspeaker apparatus. The signal containing the sound information may be not limited to an electrical signal, and may also include other forms of signals other than the electrical signal, such as an optical signal, a magnetic signal, and a mechanical signal, or the like. In principle, as long as the signal includes information that may be used to generate sounds by loudspeaker apparatus, the signal may be processed as the sound signal. In some embodiments, the sound signal may not be limited to one signal source, and it may come from a plurality of signal sources. The plurality of signal sources may be independent of or dependent on each other. In some embodiments, manners of generating or transmitting the sound signal may be wired or wireless and may be real-time or time-delayed. For example, the loudspeaker apparatus may receive an electrical signal containing sound information via a wired or wireless connection or may obtain data directly from a storage medium and generate a sound signal. Taking bone conduction technology as an example, components with sound collection function may be added to a bone conductive loudspeaker. The bone conductive loudspeaker may pick up sound from ambient environment and convert mechanical vibration of the sound into an electrical signal. Further, the electrical signal may be processed through an amplifier to meet special requirements. The wired connection may be realized by using including but not limited to metal cables, optical cables, or hybrid cables of metal and optical, such as coaxial cables, communication cables, flexible cables, spiral cables, non-metal sheathed cables, metal sheathed cables, multi-core cables, twisted pair cables, ribbon cables, shielded cables, telecommunications cables, double-stranded cables, parallel twin-core wires, and twisted pairs. Examples described above are only used for illustration purposes. The wired connection may also be realized by using other types of transmission carriers, such as transmission carriers for electrical or optical signal.

The storage device or storage unit mentioned herein may include a direct attached storage, a network attached storage, a storage area network, and other storage systems. The storage device may include but is not limited to common types of storage devices such as a solid-state storage device (a solid-state drive, a solid-state hybrid hard drive, etc.), a mechanical hard drive, a USB flash drive, a memory stick, a storage card (e.g., CF, SD, etc.), and other drives (e.g., CD, DVD, HD DVD, Blu-ray, etc.), a random access memory (RAM), a read-only memory (ROM), etc. The RAM may include but is not limited to a decimal counter, a selection tube, a delay line memory, a Williams tube, a dynamic random access memory (DRAM), a static random access memory (SRAM), a thyristor random access memory (T-RAM), a zero capacitive random access memory (Z-RAM), etc. The ROM may include but is not limited to a magnetic bubble memory, a magnetic button line memory, a thin film memory, a magnetic plating line memory, a magnetic core memory, a drum memory, an optical disk driver, a hard disk, a magnetic tape, an early non-volatile memory (NVRAM), a phase change memory, a magneto-resistive random access memory, a ferroelectric random access memory, a non-volatile SRAM, a flash memory, an electronically erasable rewritable read-only memory, an erasable programmable read-only memory, a programmable read-only memory, a shielded heap read memory, a floating connection gate random access memory, a nano random access memory, a racetrack memory, a variable resistance memory, a programmable metallization unit, etc. The storage device/storage unit mentioned above are only used for illustration purposes. The storage medium used in the storage device/storage is not limited.

In 102, the loudspeaker apparatus may convert the signal containing sound information into vibrations to generate a sound. The loudspeaker apparatus may use a specific transducer to convert the signal into mechanical vibrations accompanying with energy conversion. The conversion process may include multiple types of energy coexistence and conversion. For example, the electrical signal may be directly converted into mechanical vibrations by the transducers to generate a sound. As another example, the sound information may be included in an optical signal, which may be converted into mechanical vibrations by a specific transducer. Other types of energy that may be coexisted and converted when the transducer works may include thermal energy, magnetic field energy, or the like. In some embodiments, an energy conversion manner of the transducer may include but is not limited to, a moving coil type, an electrostatic type, a piezoelectric type, a moving iron type, a pneumatic type, an electromagnetic type, or the like. A frequency response range and sound quality of the loudspeaker apparatus may be affected by the energy conversion manner and a property of each physical component of the transducer. For example, in a transducer with the moving coil type, a wound cylindrical coil is connected to a vibration plate, the coil driven by a signal current drives the vibration plate to vibrate in the magnetic field, and generate a sound. Factors, such as material expansion and contraction, folds deformation, size, shape, and fixed manner of the vibration plate, the magnetic density of the permanent magnet, etc., may have a large impact on the sound quality of the loudspeaker apparatus.

The term "sound quality" used herein may indicate the quality of sound, which refers to an audio fidelity after post-processing, transmission, or the like. In an audio device, the sound quality may include audio intensity and magnitude, audio frequency, audio overtone, or harmonic components, or the like. When the sound quality is evaluated, measuring manner and the evaluation criteria for objectively evaluating the sound quality may be used, other manners that combine different elements of sound and subjective feelings for evaluating various properties of the sound quality may also be used. Thus, the sound quality may be affected during the processes of generating the sound, transmitting the sound, and receiving the sound.

In 103, the sound is delivered by a delivery system. In some embodiments, the delivery system refers to a substance that can deliver vibration signals containing sound information, such as the skull, bony labyrinth, inner ear lymph, and spiral organs of humans or/and animals with auditory systems. As another example, the delivery system also refers to a medium that may transmit sound (e.g., air and liquid). To illustrate the process of transmitting sound information by the delivery system, a bone conductive loudspeaker may be taken as an example. The bone conductive loudspeaker may directly transmit sound waves (vibration signals) converted from electrical signals to an auditory center through bones. In addition, the sound waves may be transmitted to the auditory center through air conduction. For the content of air conduction, please refer to the description elsewhere in the specification.

In 104, the sound information is transferred to a sensing terminal. Specifically, the sound information is transmitted to the sensing terminal through the delivery system. In a working scenario, the loudspeaker apparatus picks up or generates a signal containing sound information, converts the sound information into a sound vibration by the transducer. The loudspeaker apparatus transmits the sound to the sensing terminal through the delivery system, and finally a user can hear the sound. Generally, the subject of the sensing terminal, the auditory system, the sensory organ, etc. described above may be a human or an animal with an auditory system. It should be noted that the following description of the loudspeaker apparatus used by a human does not constitute a restriction on the use scene of the loudspeaker apparatus, and similar descriptions may also be applied to other animals.

The above description of the process of the loudspeaker apparatus is only a specific example and should not be regarded as the only feasible implementation. Obviously, for persons having ordinary skills in the art, after understanding the basic principle of the loudspeaker apparatus, various modifications and changes may be made in the form and details to the specific ways and steps of implementing the loudspeaker apparatus without departing from the principle. However, those modifications and changes are still within the scope of the present disclosure. For example, between acquiring a signal containing sound information in operation 101 and generating sound in operation 102, a signal correction or enhancement step may be additionally added, which may enhance or modify the signal acquired in operation 101 according to a specific algorithm or parameter. Furthermore, between generating sound in operation 102 and transmitting sound in operation 103, an enhancement or a correction step of the vibration may be additionally added.

Figure 2:
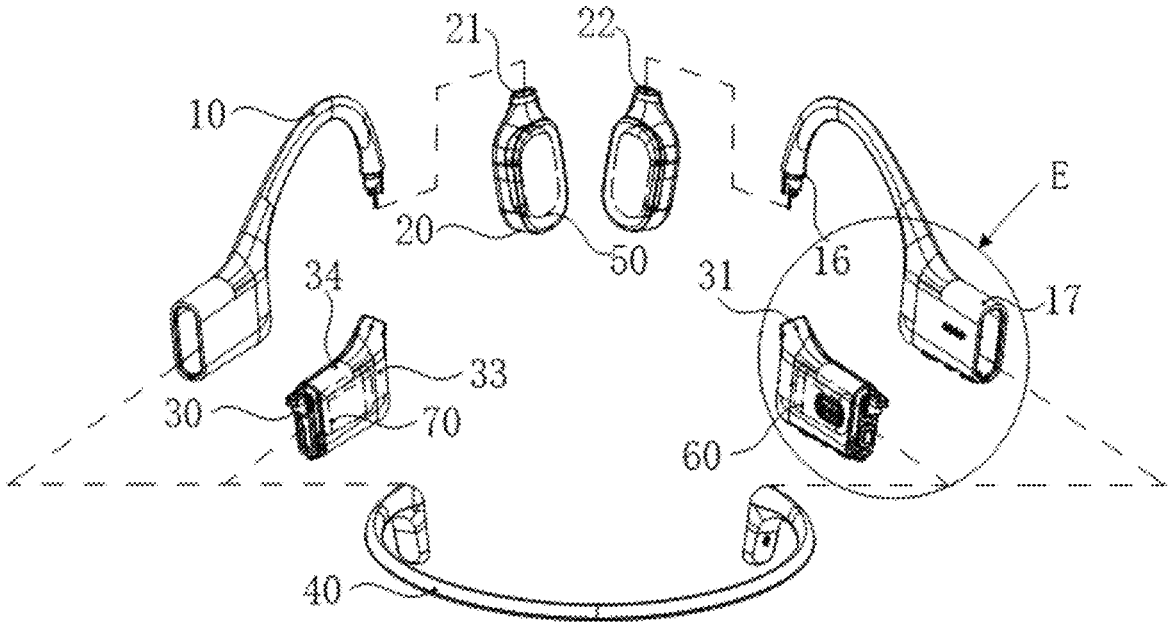
FIG. 2 is an exploded structural diagram of an MP3 player according to some embodiments of the present disclosure.
Figure 3:
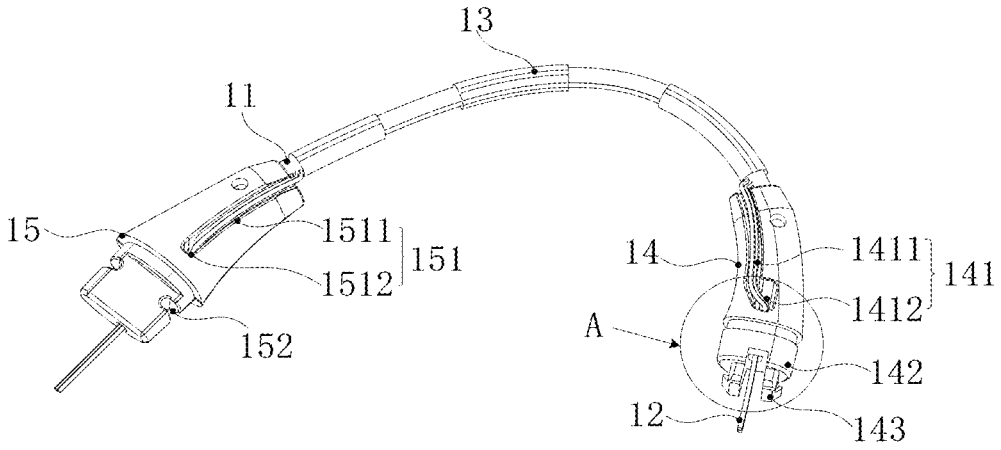
FIG. 3 is a partial structural diagram of an ear hook of an MP3 player according to some embodiments of the present disclosure.
Figure 4:
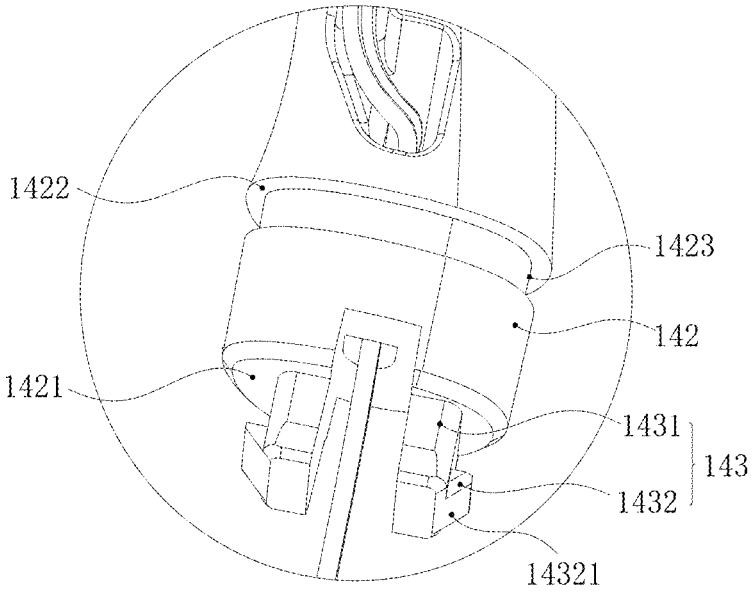
FIG. 4 is a partial enlarged view of part A in FIG. 3.

The loudspeaker apparatus in the specification of the present disclosure may include, but is not limited to, an earphone, an MP3 player, and a hearing aid. In the following specific embodiments of the present disclosure, an MP3 player is taken as an example to describe the loudspeaker apparatus in detail. FIG. 2 is an exploded structural diagram of an MP3 player according to some embodiments of the present disclosure. FIG. 3 is a partial structural diagram of an ear hook in an MP3 player according to some embodiments of the present disclosure. FIG. 4 is an enlarged view of part A in FIG. 3. As shown in FIG. 1, in some embodiments, an MP3 player may include an ear hook 10, a core housing 20, a circuit housing 30, a rear hook 40, an earphone core 50, a control circuit 60, and a battery 70. The core housing 20 and the circuit housing 30 are arranged at two ends of the ear hook 10 respectively, and the rear hook 40 is further arranged at an end of the circuit housing 30 away from the ear hook 10. The number of the core housings 20 is two, which are used to accommodate two earphone cores 50 respectively. The number of the circuit housings 30 is also two, which are used to accommodate the control circuit 60 and the battery 70 respectively. The two ends of the rear hook 40 are connected to the corresponding circuit housings 30 respectively. The ear hook 10 refers to a structure surrounding and supporting a user's ear when the user wears a bone conductive MP3 player, and then suspending and fixing the core housing 20 and the earphone core 50 at a predetermined position of the user's ear.

Combining FIG. 2, FIG. 3, and FIG. 4, in some embodiments, the ear hook 10 may include an elastic metal wire 11, a wire 12, a fixed sleeve 13, a plug end 14, and a plug end 15. The plug end 14 and the plug end 15 may be arranged at both ends of the elastic metal wire 11. In some embodiments, the ear hook 10 may further include a protective sleeve 16 and a housing sheath 17 integrally formed with the protective sleeve 16. The elastic metal wire 11 is mainly used to keep the ear hook 10 in a shape that matches the users ear. The elastic metal wire 11 has a certain elasticity, so as to generate a certain elastic deformation according to the users ear shape and head shape to adapt to users with different ear shapes and head shapes. In some embodiments, the elastic metal wire 11 may be made of a memory alloy, which has good deformation recovery ability. Thus, even if the ear hook 10 is deformed by an external force, it may still be restored to its original shape when the external force is removed, and continue to be used by users, thereby extending the life of the MP3 player. In other embodiments, the elastic metal wire 11 may also be made of a non-memory alloy. The wire 12 may be used for electrical connection with the earphone core 50, the control circuit 60, the battery 70, etc. for power supply and data transmission for the operation of the earphone core 50.

The fixed sleeve 13 may be used to fix the wire 12 on the elastic metal wire 11. In this embodiment, there are at least two fixed sleeves 13. The at least two fixed sleeves 13 may be spaced apart along the elastic metal wire 11 and the wire 12, and arranged on the outer periphery of the wire 12 and the elastic metal wire 11 by wrapping to fix the wire 12 on the elastic metal wire 11.

In some embodiments, the plug end 14 and the plug end 15 may be made of hard materials, such as plastic. In some embodiments, the plug end 14 and the plug end 15 may be formed respectively on both ends of the elastic metal wire 11 by injection molding. In some embodiments, the plug end 14 and the plug end 15 may be formed by injection molding separately. Connection holes to connect with the end of the elastic metal wire 11 are respectively reserved during the injection molding of the plug end 14 and the plug end 15. After the injection molding is completed, the plug end 14 and the plug end 15 may be inserted into the corresponding ends of the elastic metal wire 11 respectively by the connection holes or fixed by bonding.

It should be noted that, in this embodiment, the plug end 14 and the plug end 15 may not be directly formed by injection molding on the periphery of the wire 12, which avoids the wire 12 during injection molding. Specifically, when the plug end 14 and the plug end 15 are injection molded, the wire 12 located at both ends of the elastic metal wire 11 may be fixed to be far away from the position of the plug end 14 and the plug end 15. Further, a first wiring channel 141 and a second wiring channel 151 may be arranged respectively on the plug 14 and the plug end 15 to extend the wire 12 along the first wiring channel 141 and the second wiring channel 151 after the injection molding. Specifically, the wire 12 may be threaded into the first wiring channel 141 and the second wiring channel 151 in a threading way after the first wiring channel 141 and the second wiring channel 151 are formed. In some embodiments, the plug end 14 and the plug end 15 may be directly injection molded on the periphery of the wire 12 according to actual conditions, which is not specifically limited herein.

In some embodiments, the first wiring channel 141 may include a first wiring groove 1411 and a first wiring hole 1412 connecting with the first wiring groove 1411. The first wiring groove 1411 may be connected with the sidewall of the plug end 14. One end of the first wiring hole 1412 may be connected with one end of the first wiring groove 1411 and another end of the first wiring hole 1412 may be connected with the outer end surface of the plug end 14. The wire 12 at the plug end 14 may extend along the first wiring groove 1411 and the first wiring hole 1412 and be exposed on the outer end surface of the plug end 14 to further connect with other structures.

In some embodiments, the second wiring channel 151 may include a second wiring groove 1511 and a second wiring hole 1512 connecting with the second wiring groove 1511. The second wiring groove 1511 may be connected with the sidewall of the plug end 15, one end of the second wiring hole 1512 may be connected with one end of the second wiring groove 1511, and another end of the second wiring hole 1512 may be connected with the outer end surface of the plug end 15. The wire 12 at the plug end 15 may extend along the second wiring groove 1511 and the second wiring hole 1512 and be exposed on the outer end surface of the plug end 15 to further connect to other structures.

In some embodiments, the outer end surface of the plug end 14 refers to the surface of the end of the plug end 14 away from the plug end 15. The outer end surface of the plug end 15 refers to the surface of the end of the plug end 15 away from the plug end 14.

In some embodiments, the protective sleeve 16 may be injection molded around periphery of the elastic metal wire 11, the wire 12, the fixed sleeve 13, the plug end 14, and the plug end 15. Thus, the protective sleeve 16 may be fixedly connected with the elastic metal wire 11, the wire 12, the fixed sleeve 13, the plug end 14, and the plug end 15 respectively. There is no need to form the protective sleeve 16 separately by injection molding and then further wrap protective sleeve 16 around the periphery of the elastic metal wire 11, the plug end 14, and the plug end 15. It may simplify the manufacturing and assembly processes and make the fixation of the protective sleeve 16 more reliable and stable.

In some embodiments, when the protective sleeve 16 is formed, a housing sheath 17 disposed on the side close to the plug end 15 may be integrally formed with the protective sleeve 16. In some embodiments, the housing sheath 17 may be integrally formed with the protective sleeve 16 to form a whole structure. The circuit housing 30 may be connected to one end of the ear hook 10 by being fixedly connected to the plug end 15. The housing sheath 17 may be further wrapped around the periphery of the circuit housing 30 in a sleeved manner.

Specifically, when manufacturing the ear hook 10 of the MP3 player, the following steps may be implemented.

Step S101, the fixed sleeve 13 may be used to fix the wire 12 on the elastic metal wire 11. An injection position is reserved at both ends of the elastic metal wire 11. Specifically, the elastic metal wire 11 and the wire 12 may be placed side by side in a preset way, and then the fixed sleeve 13 is further sleeved around the wire 12 and the elastic metal wire 11, so as to fix the wire 12 on the elastic metal wire 11. Since the two ends of the elastic metal wire 11 still need the injection molded plug end 14 and the plug end 15, the two ends of the elastic metal wire 11 may not be completely wrapped by the fixed sleeve 13. A corresponding injection position needs to be reserved for injection molding of the plug end 14 and the plug end 15.

Step S102, the plug end 14 and the plug end 15 may be injection molded at the injection positions of the two ends of the elastic metal wire 11, respectively. The first wiring channel 141 and the second wiring channel 151 are arranged on the plug end 14 and the plug end 15, respectively.

Step S103, the wire 12 may be arranged to extend along the first wiring channel 141 and the second wiring channel 151. Specifically, after the forming of the plug end 14 and the plug end 15 is completed, the two ends of the wire 12 may be further threaded into the first wiring channel 141 and the second wiring channel 151 manually or by a machine. The part of the wire 12 located between the first wiring channel 141 and the second wiring channel 151 may be fixed on the elastic metal wire 11 by the fixed sleeve 13.

Step S104, the protective sleeve 16 may be formed by injection molding on the periphery of the elastic metal wire 11, the wire 12, the fixed sleeve 13, the plug end 14, and the plug end 15.

In some embodiments, when step S104 is performed, the housing sheath 17 may be integrally formed with the protective sleeve 16 on the periphery of the plug end 15 by injection molding.

In some embodiments, it should be noted that the wire 12 may not be arranged when the fixed sleeve 13 is installed. The wire 12 may be further arranged after the plug end 14 and the plug end 15 are injection molded. The specific steps are as follows.

Step S201, the fixed sleeve 13 may be sleeved on the elastic metal wire 11. The injection molding positions may be reserved at both ends of the elastic metal wire 11.

Step S202, the plug end 14 and the plug end 15 may be injection molded at the injection positions of the two ends of the elastic metal wire 11, respectively. The first wiring channel 141 and the second wiring channel 151 may be arranged on the plug end 14 and the plug end 15, respectively.

Step S203, the wire 12 may be threaded inside the fixed sleeve 13, so as to use the fixed sleeve 13 to fix the wire 12 on the elastic metal wire 11. Further, the wire 12 may be arranged to extend along the first wiring channel 141 and the second wiring channel 151.

It should be noted that, in this way, interference of the wire 12 may be avoided during injection molding of the plug end 14 and the plug end 15, so as to facilitate the smooth progress of molding.

It should be noted that the structure, function, and formation of the elastic metal wire 11, the wire 12, the fixed sleeve 13, the plug end 14, the plug end 15, and the protective sleeve 16 involved in the embodiment set forth above are the same as those in the foregoing embodiment, and for related details, please refer to the foregoing embodiment, which are not repeated herein.

In some embodiments, the core housing 20 may be used to accommodate the earphone core 50 and may be plugged and fixed with the plug end 14. The number of the earphone cores 50 and the core housings 20 are both two, corresponding to the left ear and the right ear of the user, respectively.

In some embodiments, the core housing 20 and the plug end 14 may be connected by plugging, clamping, etc., so as to fix the core housing 20 and the ear hook 10 together. That is, in this embodiment, the ear hook 10 and the core housing 20 may be formed separately first, and then be assembled together, instead of directly forming the two together.

In this way, the ear hook 10 and the core housing 20 may be molded separately with corresponding molds instead of using the same larger-sized mold to form the two integrally, which may reduce the size of the mold and the difficulty of mold process. In addition, since the ear hook 10 and the core housing 20 are processed by different molds, when the shape or structure of the ear hook 10 or the core housing 20 needs to be adjusted in the manufacturing process, it is sufficient to adjust the mold corresponding to the structure instead of adjusting the mold of another structure, so as to reduce the cost of production. In other embodiments, the ear hook 10 and the core housing 20 may be integrally formed according to the situation.

In some embodiments, the core housing 20 may be arranged with a socket 22 connecting with the outer end surface 21 of the core housing 20. The outer end surface 21 of the core housing 20 refers to the end surface of the core housing 20 facing the ear hook 10. The socket 22 provides an accommodating space for the plug end 14 of the ear hook 10 to be inserted into the core housing 20, so as to further realize the plug and fixation between the plug end 14 and the core housing 20.

Figure 5:
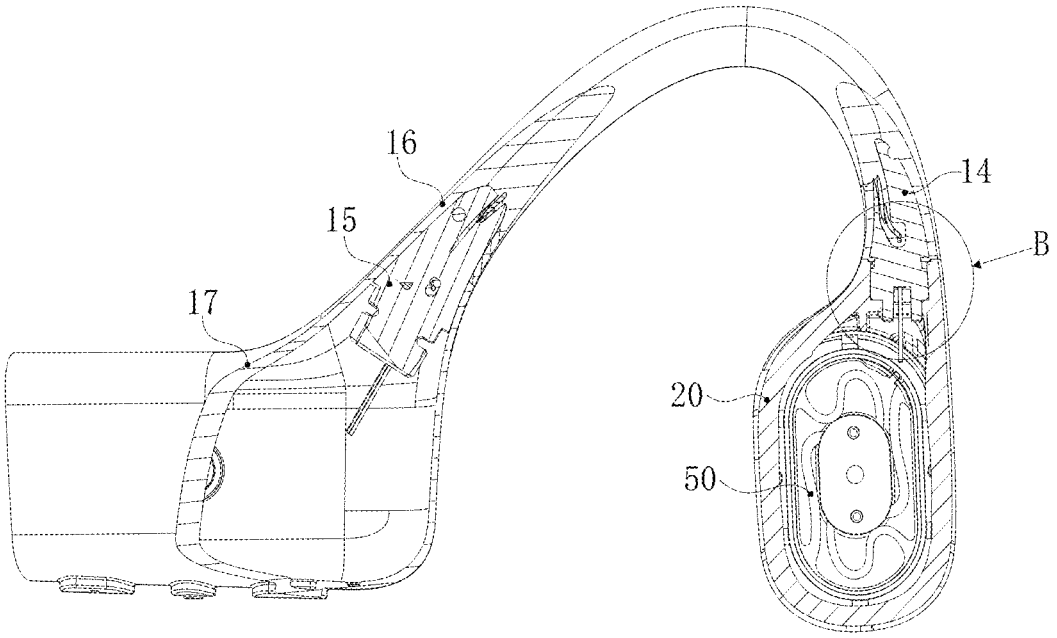
FIG. 5 is a partial sectional view of an MP3 player according to some embodiments of the present disclosure.
Figure 6:
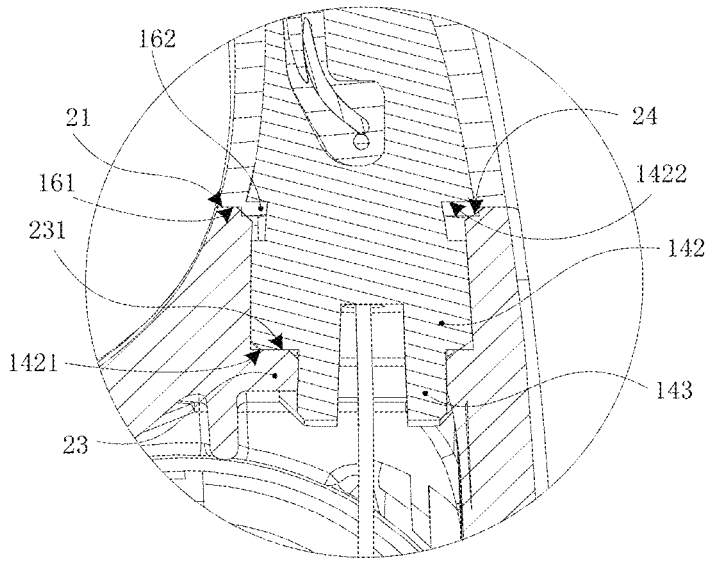
FIG. 6 is a partial enlarged view of part B in FIG. 5.

FIG. 5 is a partial sectional view of an MP3 player according to some embodiments of the present disclosure. FIG. 6 is a partial enlarged view of part B in FIG. 5.

Combining FIG. 2, FIG. 5, and FIG. 6, in some embodiments, the plug end 14 may include an inserting portion 142 and two elastic hooks 143. Specifically, the inserting portion 142 may be at least partially inserted into the socket 22 and abut against the outer side surface 231 of a stopping block 23. The shape of the outer sidewall of the inserting portion 142 matches the shape of the inner sidewall of the socket 22, so that the outer sidewall of the inserting portion 142 may abut against the inner sidewall of the socket 22 when the inserting portion 142 is at least partially inserted into the socket 22.

The outer side surface 231 of the stopping block 23 refers to a side of the stopping block 23 facing the ear hook 10. The inserting portion 142 may further include an end surface 1421 facing the core housing 20. The end surface 1421 may match the outer side surface 231 of the stopping block 23, so that the end surface 1421 of the inserting portion 142 may abut against the outer side surface 231 of the stopping block 23 when the inserting portion 142 is at least partially inserted into the socket 22.

In some embodiments, the two elastic hooks 143 may be arranged side by side and spaced apart symmetrically on the side of the inserting portion 142 facing the inside of the core housing 20 along the direction of insertion. The two elastic hooks 143 may be brought together under action of external thrust and the stopping block 23. After passing through the stopping block 23, the two elastic hooks 143 may be elastically restored to be stuck on an inner surface of the stopping block 23 to realize the fixation of the core housing 20 and the plug end 14. Each elastic hook 143 may include a beam portion 1431 and a hook portion 1432. The beam portion 1431 may be connected to the side of the inserting portion 142 facing the core housing 20. The hook portion 1432 may be arranged on the beam portion 1431 away from the inserting portion 142 and extend perpendicular to the inserted direction. Each hook portion 1432 may be arranged with a side parallel to the inserted direction and a transitional slope 14321 away from the inserting portion 142.

In some embodiments, after the core housing 20 and the plug end 14 are plugged and fixed, the inserting portion 142 may be partially inserted into the socket 22. The exposed portion of the inserting portion 142 may be arranged in a stepped manner, so as to form an annular table surfaces 1422 spaced apart from the outer end surface 21 of the core housing 20. The exposed portion of the inserting portion 142 refers to the portion of the inserting portion 142 exposed to the core housing 20. Specifically, the exposed portion of the inserting portion 142 refers to the portion exposed to the core housing 20 and close to the outer end surface of the core housing 20.

In some embodiments, the annular table surface 1422 may be arranged opposite to the outer end surface 21 of the core housing 20. The spacing between the two may refer to the spacing along the direction of insertion and the spacing perpendicular to the direction of insertion.

In some embodiments, the protective sleeve 16 may extend to the side of the annular table surface 1422 facing the outer end surface 21 of the core housing 20. When the socket 22 and the plug end 14 of the core housing 20 is plugged and fixed, the protective sleeve 16 may be at least partially filled in the space between the annular table surface 1422 and the outer end surface 21 of the core housing 20, and elastically abut against the core housing 20. Thus, it is difficult for external liquid to enter the inside of the core housing 20 from the junction between the plug end 14 and the core housing 20, thereby realizing the sealing between the plug end 14 and the socket 22, protecting the earphone core 50, etc. inside the core housing 20, and improving the waterproof effect of the bone conductive MP3 player.

Specifically, in some embodiments, the protective sleeve 16 forms an annular abutting surface 161 on the outer end surface 21 of the annular table surface 1422 facing the outer end surface of the core housing 20. The annular abutting surface 161 may be the end surface of the protective sleeve 16 facing the core housing 20.

In some embodiments, the protective sleeve 16 may further include an annular boss 162 locating inside the annular abutting surface 161 and protruding from the annular abutting surface 161. Specifically, the annular boss 162 may be formed on the side of the annular abutting surface 161 facing the plug end 14, and be protrudingly arranged toward the core housing 20 relative to the annular abutting surface 161. Further, the annular boss 162 may also be directly formed on the periphery of the annular table surface 1422 and cover the annular table surface 1422.

In some embodiments, the core housing 20 may include a connecting slope 24 for connecting the outer end surface 21 of the core housing 20 and the inner sidewall of the socket 22. The connecting slope 24 may be the transitional surface between the outer end surface 21 of the core housing 20 and the inner sidewall of the socket 22. The connecting slope 24 may be not on the same plane as the outer end surface 21 of the core housing 20 and the inner sidewall of the socket 22. In some embodiments, the connecting slope 24 may be a flat surface, or may also be a curved surface or other shapes according to actual requirements, there is no specific limitation herein.

Specifically, when the core housing 20 and the plug end 14 are plugged and fixed, the annular abutting surface 161 and the annular boss 162 may elastically abut against the outer end surface of the core housing 20 and the connecting slope 24, respectively. It should be noted that since the outer end surface 21 of the core housing 20 and the connecting slope 24 are not on the same plane, the elastic abutment between the protective sleeve 16 and the core housing 20 may be not on the same plane. Thus, it is difficult for external liquid to enter the core housing 20 from the junction of the protective sleeve 16 and the core housing 20, and further enter the earphone core 50, so as to improve the waterproof effect of the MP3 player, protect the inner functional structure, and extend the lifetime of the MP3 player.

In some embodiments, the inserting portion 142 may be further formed with an annular groove 1423 adjacent to the annular table surface 1422 on the side of the annular table surface 1422 facing the outer end surface 21 of the core housing 20. The annular boss 162 may be formed in the annular groove 1423.

In some embodiments, an end of the wire 12 of the ear hook 10 arranged outside the core housing 20 may pass through the second wiring channel 151 to connect the circuits outside the core housing 20, such as the control circuit 60, the battery 70, etc. included in the circuit housing 30. Another end of the wire 12 may be exposed to the outer end surface of the plug end 14 along the first wiring channel 141, and further enter the core housing 20 through the socket 22 along with the inserting portion 142.

Figure 7:
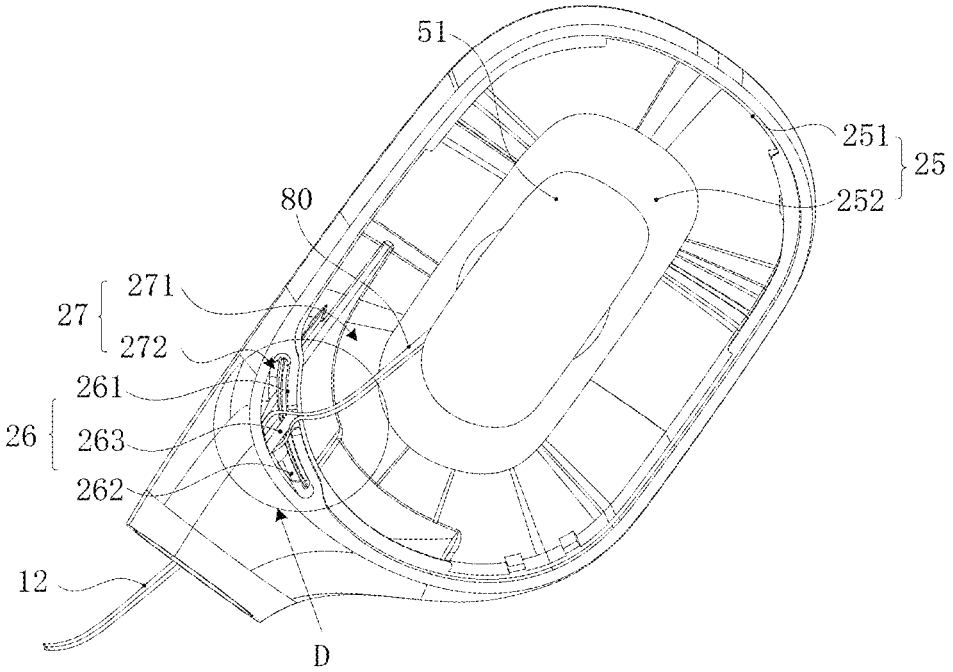
FIG. 7 is a partial structural diagram of a core housing according to some embodiments of the present disclosure.
Figure 8:
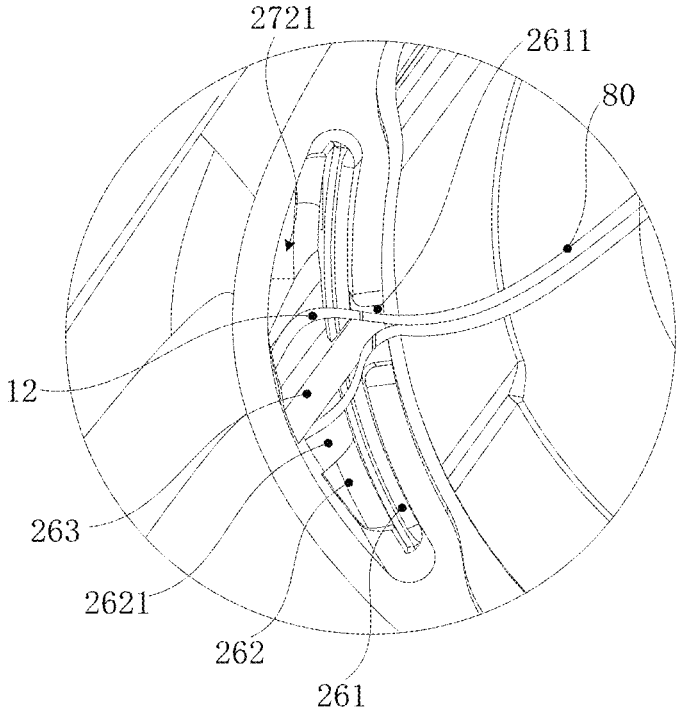
FIG. 8 is a partial enlarged view of part D in FIG. 7.
Figure 9:
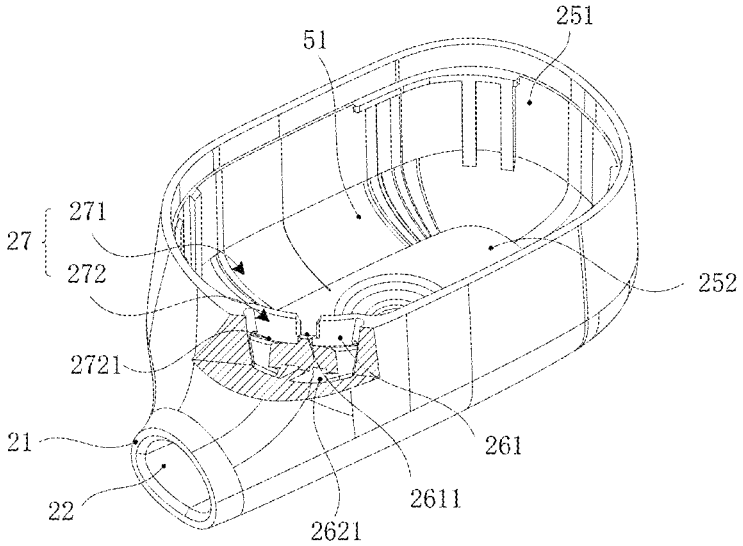
FIG. 9 is a partial sectional view of a core housing according to some embodiments of the present disclosure.

FIG. 7 is a partial structural diagram of the core housing according to some embodiments of the present disclosure. FIG. 8 is a partial enlarged view of part D in FIG. 7. FIG. 9 is a partial sectional view of a core housing according to some embodiments of the present disclosure.

Combing FIG. 2, FIG. 7, FIG. 8, and FIG. 9, in some embodiments, the core housing 20 may include a main housing 25 and a partition component 26. The partition component 26 may be arranged inside the main housing 25 and connected to the main housing 25, so as to divide the inner space 27 of the main housing 25 into a first accommodating space 271 and a second accommodating space 272 on the side close to the socket 22. In some embodiments, the main housing 25 may include a peripheral sidewall 251 and a bottom wall 252 connected to one end surface of the peripheral sidewall 251. The peripheral sidewall 251 and the bottom wall 252 jointly form the inner space 27 of the main housing.

The partition component 26 may be arranged on the side of the main housing 25 close to the socket 22 and include a side partition 261 and a bottom partition 262. The side partition 261 may be arranged in a direction perpendicular to the bottom wall 252 and both ends of the side partition 261 may be connected with the peripheral sidewall 251, thereby separating the inner space 27 of the main housing 25. The bottom partition 262 and the bottom wall 252 may be parallel or nearly parallel and spaced apart. Further, the bottom partition 262 and the bottom wall 252 may be connected to the peripheral side wall 251 and the side partition 261, respectively. Thus, the inner space 27 formed by the main housing 25 may be divided into two to form the first accommodating space 271 surrounded by the side partition 261, the bottom partition 262, the peripheral sidewall 251 away from the socket 22, and the bottom wall 252, and the second accommodating space 272 surrounded by the bottom partition 262, the side partition 261, and the peripheral sidewall 251 close to the socket 22. The second accommodating space 272 may be smaller than the first accommodating space 271. The partition component 26 may also divide the inner space 27 of the main housing 25 by other arrangements, which are not specifically limited herein.

In some embodiments, the earphone core may include a functional component 51 that may be arranged in the first accommodating space 271 and used for vibrating and generating sound. In some embodiments, the MP3 player may further include a wire 80 connected to the functional component 51. An end of the wire 80 may be extended from the first accommodating space 271 to the second accommodating space 272.

In some embodiments, the side partition 261 may be arranged with a wiring groove 2611 at the top edge away from the bottom wall 252. The wiring groove 2611 may connect the first accommodation space 271 and the second accommodation space 272. Further, an end of the wire 12 away from the functional component may extend into the second accommodating space 272 through the wire groove 2611.

After the end of the wire 12 away from the circuit housing 30 entering the core housing 20 with the inserting portion 142, the end of the wire 12 may further extend into the second accommodating space 272 and be electrically connected to the wire 80 in the second accommodating space 272, so that a wire path connecting the first accommodating space 271 to an external circuit through the second accommodating space 272 may be formed. Thus, the functional component 51 may be electrically connected to the external circuit arranged outside the core housing 20 through the wire path.

In some embodiments, the bottom partition 262 may also be arranged with a wiring hole 2621, which connects the socket 22 with the second accommodating space 272, so that the wire 12 entering the core housing from the socket 22 may extend to the second accommodating space 272 through the wiring hole 2621.

The wire 12 and the wire 80 may be coiled and arranged in the second accommodating space 272 after being connected in the second accommodating space 272. Specifically, the wire 12 and the wire 80 may be connected together by welding. Further, the functional component 51 may be electrically connected to the external circuit, so as to provide power for the normal operation of the functional component 51 through the external circuit or transmit data to the earphone core 50.

It should be noted that when assembling the bone conductive MP3 player, the wire is often longer than the actual requirement to facilitate assembly. However, if the extra wires of the earphone core 50 may not be placed reasonably, it is easy to vibrate and make abnormal noises when the functional component 51 is working, thereby reducing the sound quality of the bone conductive MP3 player and affecting the user's experience of listening. In this embodiment, the second accommodating space 272 may be separated from the inner space 27 formed by the main housing 25 of the core housing 20 and used for accommodating extra wires 12 and wires 80, so as to avoid or reduce the influence of the extra wires on the sound generated by the bone conductive MP3 player due to vibration, thereby improving the sound quality.

In some embodiments, the partition component 26 may further include an inner partition 263. The inner partition 263 may further divide the second accommodating space 272 into two sub-accommodating spaces 2721. Specifically, the inner partition 263 may be arranged perpendicular to the bottom wall 252 of the main housing 25 and connected to the side partition 261 and the peripheral sidewall 251 respectively, and further extend to the wiring hole 2621, so as to divide the wiring hole 2621 into two, while dividing the second accommodating space 272 into two sub-accommodating spaces 2721. Each of the two wiring holes 2621 may be connected with a corresponding sub-accommodating space 2721 respectively.

In this embodiment, there are two wires 12 and two wires 80. The two wires 12 may extend into respective sub-accommodating spaces 2721 along the corresponding wiring holes 2621 respectively. The two wires 80 may enter the second accommodating space 272 through the wiring groove 2611 together, separate after entering the second accommodating space 272, be welded with the corresponding wires 12 in the corresponding sub-accommodating spaces 2721 respectively, and further be coiled and arranged in the corresponding sub-accommodating space 2721.

In some embodiments, the second accommodating space 272 may be further filled with sealant. In this way, the wire 12 and the wire 80 included in the second accommodating space 272 may be further fixed, which may reduce the adverse effect on the sound quality caused by the vibration of the wire, improve the sound quality of the bone conductive MP3 player, and protect the welding point between the wire 12 and the wire 80. In addition, the purpose of waterproof and dustproof may also be achieved by sealing the second accommodating space 272.

Referring to FIG. 2 and FIG. 3, in some embodiments, the circuit housing 30 and the plug end 15 may be plugged and fixed, so that the circuit housing 30 may be fixed to the end of the ear hook 10 away from the core housing 20. When worn by the user, the circuit housing 30 including the battery 70 and the circuit housing 30 including the control circuit 60 may correspond to the left and right side of the user, respectively. The way of plug and connection of the circuit housing 30 and the control circuit 60 may be different from the corresponding plug end 15.

Specifically, the circuit housing 30 may be connected to the plug end 15 through plug and connection, snap connection, or the like. In other words, in this embodiment, the ear hook 10 and the circuit housing 30 may be formed separately, and then be assembled after the form is completed, instead of directly forming the two together.

In this way, the ear hook 10 and the circuit housing 30 may be molded separately with respective corresponding molds, instead of using the same larger-sized mold to form the two integrally, which may reduce the size of the molding mold and the difficulty of mold process. In addition, since the ear hook 10 and the circuit housing 30 are processed by different molds, when the shape or structure of the ear hook 10 or the circuit housing 30 needs to be adjusted in the manufacturing process, it is sufficient to adjust the mold corresponding to the structure. There is no need to adjust the mold corresponding to another structure, so as to reduce the cost of production.

In some embodiments, the circuit housing 30 may be arranged with a socket 31. The shape of the inner surface of the socket 31 may match the shape of at least part of the outer end surface of the plug end 15, so that the plug end 15 may be at least partially inserted into the socket 31.

Further, a slot 152 perpendicular to the inserted direction of the plug end 15 with respect to the socket 31 may be arranged on opposite sides of the plug end 15, respectively. Specifically, the two slots 152 may be symmetric and spaced apart on opposite sides of the plug end 15, and both are connected to the sidewall of the plug end 15 in the vertical direction along the inserted direction.

Referring to FIG. 2, the circuit housing 30 may be flat. For example, the cross-section of the circuit housing 30 at the second socket 31 may be elliptical or other shapes that may be flattened. In this embodiment, the two opposite sidewalls of the circuit housing 30 with a larger area are main sidewalls 33 and the two opposite sidewalls with a smaller area connecting the two main sidewalls 33 are auxiliary sidewalls 34.

It should be noted that the above description of the MP3 player is only a specific example and should not be regarded as the only feasible implementation solution. Obviously, for those skilled in the art, after understanding the basic principles of the MP3 player, various modifications and changes in forms and details of the specific methods and steps for implementing the MP3 player may be made without departing from the principles. However, those modifications and changes are still within the scope described above. For example, the number of the fixed sleeves 13 is not limited to the at least two described in the embodiments set forth above. The number of the fixed sleeves 13 may also be one, which may be specifically determined according to actual requirements. As another example, the shape of the cross-section of the circuit housing 30 at the socket 31 is not limited to be elliptical. The shape of the cross-section may also be other shapes, such as a triangle, a quadrilateral, a pentagon, and other polygons. Such modifications are all within the protection scope of the present disclosure.

Figure 10:
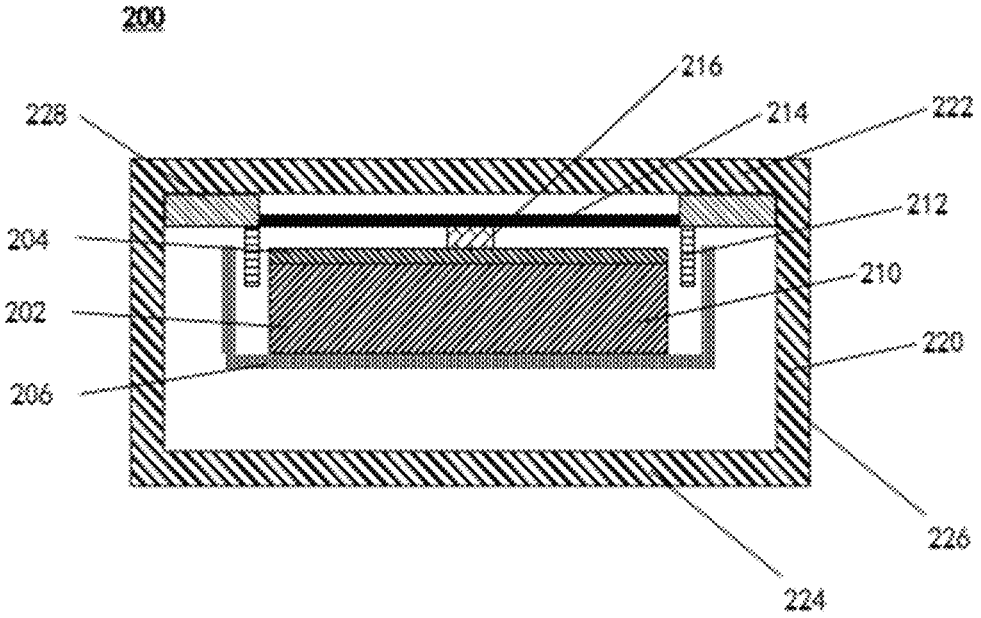
FIG. 10 a longitudinal sectional view illustrating a bone conduction speaker according to some embodiments of the present disclosure.

For illustration purposes, the bone conduction speaker is taken as an example of the loudspeaker apparatus. FIG. 10 is a longitudinal sectional view illustrating a bone conduction speaker according to some embodiments of the present disclosure. It should be noted that the bone conduction speaker 200 in FIG. 10 corresponds to the core housing 20 and the earphone core 50 in FIG. 2. The housing 220 corresponds to the core housing 20, and the multiple components in the housing 220 correspond to the earphone core 50. As shown in FIG. 10, in some embodiments, the bone conduction speaker 200 may include a magnetic circuit component 210, a coil 212, a vibration transmission plate 214, a connector 216, and an housing 220.

In some embodiments, the housing 220 may include a housing panel 222, a housing back panel 224, and a housing side panel 226. The housing back panel 224 may be located on the side opposite to the housing panel 222 and may be arranged on the two ends of the housing side panel 226, respectively. The housing panel 222, the housing back panel 224, and the housing side panel 226 may form an integral structure with a certain accommodation space. In some embodiments, the magnetic circuit component 210, the coil 212, and the vibration transmission plate 214 may be fixed inside the housing 220. In some embodiments, the bone conduction speaker 200 may further include a housing bracket 228. The vibration transmission plate 214 may be connected to the housing 220 by the housing bracket 228, and the coil 212 may be fixed on the housing bracket 228 and may drive the housing 220 to vibrate by the housing bracket 228. In some embodiments, the housing bracket 228 may be a part of the housing 220, or may be a separate component, directly or indirectly connected to the inside of the housing 220. In some embodiments, the housing bracket 228 may be fixed on the inner surface of the housing side panel 226. In some embodiments, the housing bracket 228 may be pasted on the housing 220 by glue, or may be fixed on the housing 220 by stamping, injection molding, clamping, riveting, threaded connecting or welding.

In some embodiments, it is possible to design the connection mode of the housing panel 222, the housing back panel 224, and the housing side panel 226 to ensure that the housing 220 has large rigidity. For example, the housing panel 222, the housing back panel 224, and the housing side panel 226 may be integrally formed. As another example, the housing back panel 224 and the housing side panel 226 may be an integral structure. The housing panel 222 and the housing side panel 226 may be directly pasted and fixed by glue, or fixed by clamping, welding, or threaded connecting. The glue may be glue with strong viscosity and high hardness. As another example, the housing panel 222 and the housing side panel 226 may be an integral structure, the housing back panel 224 and the housing side panel 226 may be directly pasted and fixed by glue, or may be fixed by clamping, welding, or threaded connecting. In some embodiments, the housing panel 222, the housing back panel 224, and the housing side panel 226 may be all independent components, which may be fixed by one or a combination of glue, clamping, welding, or threaded connecting. For example, the housing panel 222 and the housing side panel 226 may be connected by glue, the housing back panel 224 and the housing side panel 226 may be connected by clamping, welding, or threaded connecting. As another example, the housing back panel 224 and the housing side panel 226 may be connected by glue, the housing panel 222 and the housing side panel 226 may be connected by clamping, welding, or threaded connecting.

In different application scenarios, the housing illustrated in the present disclosure may be made by different assembly techniques. For example, as described elsewhere in the present disclosure, the housing may be integrally formed, and may also be formed in a separate combination manner, or a combination thereof. In the separate combination manner, different components may be fixed by glue, or fixed by clamping, welding, or threaded connecting. Specifically, in order to better understand the assembly technique of the housing of the bone conduction earphone in the present disclosure, FIGS. 11-13 describe several examples of the assembly technique of the housing.

Figure 11:
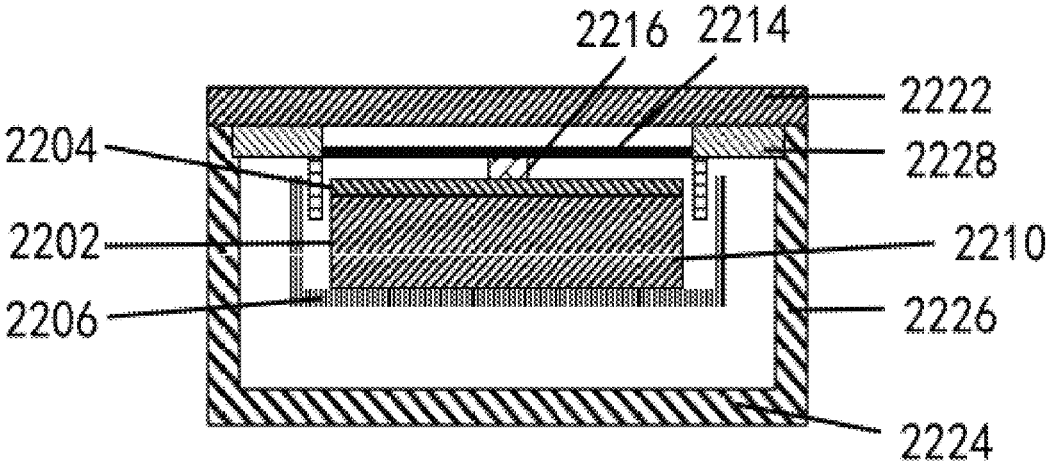
FIG. 11 is a structural diagram illustrating a bone conduction speaker according to some embodiments of the present disclosure.

As shown in FIG. 11, a bone conduction speaker may mainly include a magnetic circuit component 2210 and a housing. In some embodiments, the magnetic circuit component 2210 may include a first magnetic unit 2202, a first magnetically conductive unit 2204, and a second magnetically conductive unit 2206. The housing may include a housing panel 2222, a housing back panel 2224, and a housing side panel 2226. The housing side panel 2226 and the housing back panel 2224 may be made in an integral manner, and the housing panel 2222 may be connected to one end of the housing side panel 2226 in a split combination manner. The split combination manner includes fixing with glue, or fixing the housing panel 2222 to one end of the housing side panel 2226 by means of clamping, welding, or threaded connecting. The housing panel 2222 and the housing side panel 2226 (or the housing back panel 2224) may be made of different, the same, or partially the same materials. In some embodiments, the housing panel 2222 and the housing side panel 2226 may be made of the same material, and Young's modulus of the same material is greater than 2000 MPa. More preferably, Young's modulus of the same material is greater than 4000 MPa. More preferably, Young's modulus of the same material is greater than 6000 MPa. More preferably, Young's modulus of the material of the housing 220 is greater than 8000 MPa. More preferably, Young's modulus of the same material is greater than 12000 MPa. More preferably, Young's modulus of the same material is greater than 15000 MPa, and further preferably, Young's modulus of the same material is greater than 18000 MPa. In some embodiments, the housing panel 2222 and the housing side panel 2226 may be made of different materials, and Young's modulus of the different materials are greater than 4000 MPa. More preferably, Young's modulus of the different materials are greater than 6000 MPa. More preferably, Young's modulus of the different materials are greater than 8000 MPa. More preferably, Young's modulus of the different materials are greater than 12000 MPa. More preferably, Young's modulus of the different materials are greater than 15000 MPa. Further preferably, Young's modulus of the different materials are greater than 18000 MPa. In some embodiments, the material of the housing panel 2222 and/or the housing side panel 2226 includes but is not limited to AcrYlonitrile butadiene stYrene (ABS), PolYstYrene (PS), high High impact polYstYrene (HIPS), PolYpropYlene (PP), PolYethYlene terephthalate (PET), PolYester (PES), PolYcarbonate (PC)), PolYamides (PA), PolYvinYl chloride (PVC), PolYurethanes (PU), PolYvinYlidene chloride (PVC), PolYethYlene (PE), PolYmethYl methacrYlate (PMMA), PolYetheretherketone (PEEK), Phenolics (PF), Urea-formaldehYde (UF), Melamine-formaldehYde (MF), metals, alloy (such as aluminum alloy, chromium-molybdenum steel, scandium alloy, magnesium alloy, titanium alloy, magnesium-lithium alloy, nickel alloy, etc.), glass fiber or carbon fiber, or the like, or any combination thereof. In some embodiments, the material of the housing panel 2222 is glass fiber, carbon fiber, PolYcarbonate (PC), PolYamides (PA), or the like, or any combination thereof. In some embodiments, the material of the housing panel 2222 and/or the housing side panel 2226 may be made by mixing carbon fiber and polycarbonate (PC) in a certain proportion. In some embodiments, the material of the housing panel 2222 and/or the housing side panel 2226 may be made by mixing carbon fiber, glass fiber, and PolYcarbonate (PC) in a certain proportion. In some embodiments, the material of the housing panel 2222 and/or the housing side panel 2226 may be made by mixing glass fiber and PolYcarbonate (PC) in a certain proportion, or it may be made by mixing glass fiber and PolYamides (PA) in a certain proportion.

In some embodiments, the housing panel 2222, the housing back panel 2224, and the housing side panel 2226 may form an integral structure with a certain accommodation space. In the integral structure, the vibration transmission plate 2214 may be connected to the magnetic circuit component 2210 by the connector 2216. The two ends of the magnetic circuit component 2210 may be connected to the first magnetically conductive unit 2204 and the second magnetically conductive unit 2206, respectively. The vibration transmission plate 2214 may be fixed inside the integral structure by the housing bracket 2228. In some embodiments, the housing side panel 2226 may have a stepped structure for supporting the housing bracket 2228. After the housing bracket 2228 is fixed on the housing side panel 2226, the housing panel 2222 may be fixed on the housing bracket 2228 and the housing side panel 2226 at the same time, or separately fixed on the housing bracket 2228 or the housing side panel 2226. Under the circumstances, optionally, the housing side panel 2226 and the housing bracket 2228 may be integrally formed. In some embodiments, the housing bracket 2228 may be directly fixed on the housing panel 2222 (for example, by glue, clamping, welding, threaded connecting, etc.). The fixed housing panel 2222 and housing bracket 2228 may be then fixed to the housing side panel (for example, by glue, clamping, welding, threaded connecting, etc.). Under the circumstances, optionally, the housing bracket 2228 and the housing panel 2222 may be integrally formed.

Figure 12:
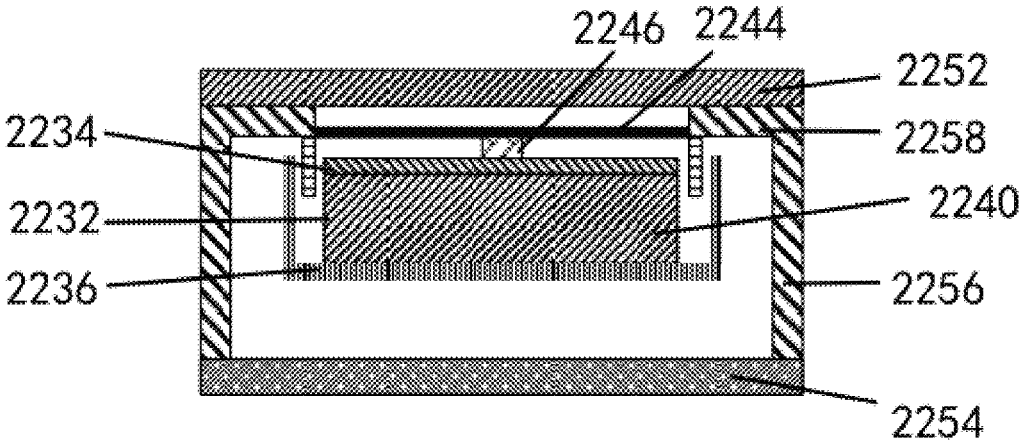
FIG. 12 is a structural diagram illustrating another bone conduction speaker according to some embodiments of the present disclosure.

In another specific embodiment, as shown in FIG. 12, the bone conduction speaker may mainly include a magnetic circuit component 2240 and a housing. The magnetic circuit component 2240 may include a first magnetic unit 2232, a first magnetically conductive unit 2234, and a second magnetically conductive unit 2236. In the integral structure, a vibration transmission plate 2244 may be connected to the magnetic circuit component 2240 by a connector 2246. This embodiment is different from the embodiment provided in FIG. 11 in that the housing bracket 2258 and the housing side panel 2256 may be integrally formed. The housing panel 2252 may be fixed to an end of the housing side panel 2256 connected to the housing bracket 2258 (for example, by glue, clamping, welding, threaded connecting, etc.), and the housing back 2254 may be fixed to the other end of the housing side panel 2256 (for example, by glue, clamping, welding, threaded connecting, etc.). Under the circumstances, optionally, the housing bracket 2258 and the housing side panel 2256 may be splitable and combined structures. The housing panel 2252, the housing back panel 2254, the housing bracket 2258, and the housing side panel 2256 may be all fixedly connected by glue, clamping, welding, threaded connecting, etc.

Figure 13:
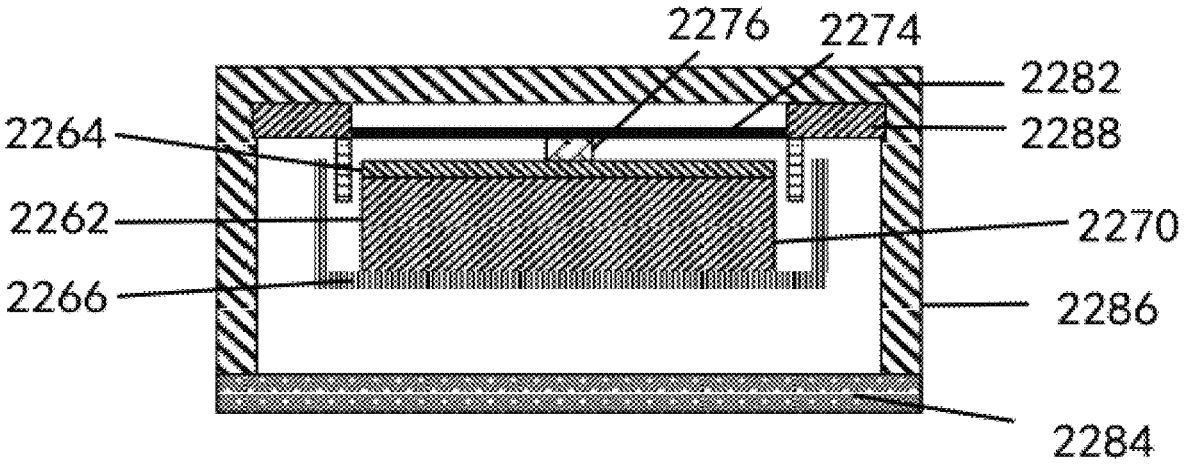
FIG. 13 is a structural diagram illustrating another bone conduction speaker according to some embodiments of the present disclosure.

In another specific embodiment, as shown in FIG. 13, the bone conduction speaker in the embodiment may mainly include a magnetic circuit component 2270 and a housing. The magnetic circuit component 2270 may include a first magnetic unit 2262, a first magnetically conductive unit 2264, and a second magnetically conductive unit 2266. In the integral structure, a vibration transmission plate 2274 may be connected to the magnetic circuit component 2270 by a connector 2276. The difference between this embodiment and the embodiment provided in FIG. 12 is that the housing panel 2282 and the housing side panel 2286 may be integrally formed. The housing back panel 2284 may be fixed on an end of the housing side panel 2286 opposite to the housing side panel 2282 (for example, by glue, clamping, welding, threaded connecting, etc.). The housing bracket 2288 may be fixed on the housing panel 2282 and/or the housing side 2286 by glue, clamping, welding, or threaded connecting. Under the circumstances, optionally, the housing bracket 2288, the housing panel 2282, and the housing side panel 2286 may be integrally formed.

Figure 14:
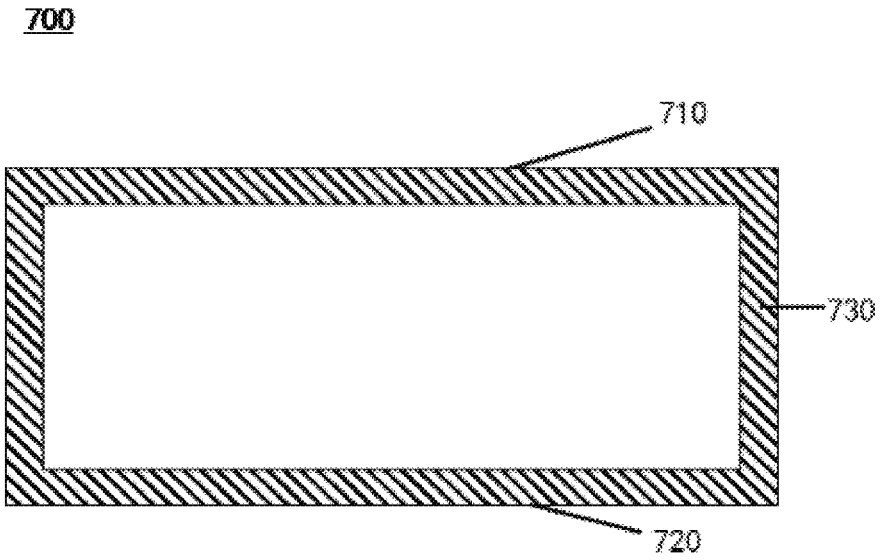
FIG. 14 is a structural diagram illustrating a housing of a bone conduction speaker according to some embodiments of the present disclosure.

FIG. 14 is a structural diagram illustrating a housing of a bone conduction speaker according to some embodiments of the present disclosure. As shown in FIG. 14, the housing 700 may include a housing panel 710, a housing back panel 720, and a housing side panel 730. The housing panel 710 may be in contact with the human body and transmits the vibration of the bone conduction speaker to the auditory nerve of the human body. In some embodiments, when the overall rigidity of the housing 700 is relatively large, the vibration amplitudes and phases of the housing panel 710 and the housing back panel 720 keep the same or substantially the same (the housing side panel 730 does not compress air and therefore does not generate sound leakage) within a certain frequency range, so that a first leaked sound signal generated by the housing panel 710 and a second leaked sound signal generated by the housing back panel 720 may be superimposed on each other. The superposition may reduce the amplitude of the first leaked sound wave or the second leaked sound wave, thereby achieving the purpose of reducing the sound leakage of the housing 700. In some embodiments, the certain frequency range includes at least the portion with a frequency greater than 500 Hz. Preferably, the certain frequency range includes at least the portion with a frequency greater than 600 Hz. Preferably, the certain frequency range includes at least the portion with a frequency greater than 800 Hz. Preferably, the certain frequency range includes at least the portion with a frequency greater than 1000 Hz. Preferably, the certain frequency range includes at least the portion with a frequency greater than 2000 Hz. More preferably, the certain frequency range includes at least the portion with a frequency greater than 5000 Hz. More preferably, the certain frequency range includes at least the portion with a frequency greater than 8000 Hz. Further preferably, the certain frequency range includes at least the portion with a frequency greater than 10000 Hz.

In some embodiments, the rigidity of the housing of the bone conduction speaker may affect the vibration amplitudes and phases of different parts of the housing (for example, the housing panel, the housing back panel, and/or the housing side panel), thereby affecting the sound leakage of the bone conduction speaker. In some embodiments, when the housing of the bone conduction speaker has a relatively large rigidity, the housing panel and the housing back panel may keep the same or substantially the same vibration amplitude and phase at higher frequencies, thereby significantly reducing the sound leakage of the bone conduction earphone.

In some embodiments, the higher frequency may include a frequency not less than 1000 Hz, for example, a frequency between 1000 Hz and 2000 Hz, a frequency between 1100 Hz and 2000 Hz, a frequency between 1300 Hz and 2000 Hz, a frequency between 1500 Hz and 2000 Hz, a frequency between 1700 Hz-2000 Hz, a frequency between 1900 Hz-2000 Hz. Preferably, the higher frequency mentioned herein may include a frequency not less than 2000 Hz, for example, a frequency between 2000 Hz and 3000 Hz, a frequency between 2100 Hz and 3000 Hz, a frequency between 2300 Hz and 3000 Hz, a frequency between 2500 Hz and 3000 Hz, a frequency between 2700 Hz-3000 Hz, or a frequency between 2900 Hz-3000 Hz. Preferably, the higher frequency may include a frequency not less than 4000 Hz, for example, a frequency between 4000 Hz and 5000 Hz, a frequency between 4100 Hz and 5000 Hz, a frequency between 4300 Hz and 5000 Hz, a frequency between 4500 Hz and 5000 Hz, a frequency between 4700 Hz and 5000 Hz, or a frequency between 4900 Hz-5000 Hz. More preferably, the higher frequency may include a frequency not less than 6000 Hz, for example, a frequency between 6000 Hz and 8000 Hz, a frequency between 6100 Hz and 8000 Hz, a frequency between 6300 Hz and 8000 Hz, a frequency between 6500 Hz and 8000 Hz, a frequency between 7000 Hz-8000 Hz, a frequency between 7500 Hz-8000 Hz, or a frequency between 7900 Hz-8000 Hz. More preferably, the higher frequency may include a frequency not less than 8000 Hz, for example, a frequency between 8000 Hz-12000 Hz, a frequency between 8100 Hz-12000 Hz, a frequency between 8300 Hz-12000 Hz, a frequency between 8500 Hz-12000 Hz, a frequency between 9000 Hz-12000 Hz, a frequency between 10000 Hz-12000 Hz, or a frequency between 11000 Hz-12000 Hz.

Keeping vibration amplitudes of the housing panel and the housing back panel the same or substantially the same refers that a ratio of the vibration amplitudes of the housing panel and the housing back panel is within a certain range. For example, the ratio of the vibration amplitudes of the housing panel and the housing back panel is between 0.3 and 3. Preferably, the ratio of the vibration amplitudes of the housing panel and the housing back panel is between 0.4 and 2.5. Preferably, the ratio of the vibration amplitudes of the housing panel and the housing back panel is between 0.4 and 2.5. Preferably, the ratio of the vibration amplitudes of the housing panel and the housing back panel is between 0.5 and 1.5. More preferably, the ratio of the vibration amplitudes of the housing panel and the housing back panel is between 0.6 and 1.4. More preferably, the ratio of the vibration amplitudes of the housing panel and the housing back panel is between 0.7 and 1.2. More preferably, the ratio of the vibration amplitudes of the housing panel and the housing back panel is between 0.75 and 1.15. More preferably, the ratio of the vibration amplitudes of the housing panel and the housing back panel is between 0.8 and 1.1. More preferably, the ratio of the vibration amplitudes of the housing panel and the housing back panel is between 0.85 and 1.1. More preferably, the ratio of the vibration amplitudes of the housing panel and the housing back panel is between 0.9 and 1.05. In some embodiments, the vibrations of the housing panel and the housing back panel may be represented by other physical quantities that can characterize the vibration amplitude. For example, sound pressures generated by the housing panel and the housing back panel at a point in the space may be used to represent the vibration amplitudes of the housing panel and the housing back panel.

Keeping the vibration phases of the housing panel and the housing back panel the same or substantially the same refers that a difference between the vibration phases of the housing panel and the housing back panel is within a certain range. For example, the difference between the vibration phases of the housing panel and the housing back panel is between −90° and 90°. Preferably, the difference between the vibration phases of the housing panel and the housing back panel is between −80° and 80°. Preferably, the difference between the vibration phases of the housing panel and the housing back panel is between −60 and 60°. Preferably, the difference between the vibration phases of the housing panel and the housing back panel is between −45° and 45°. More preferably, the difference between the vibration phases of the housing panel and the housing back panel is between −30° and 30°. More preferably, the difference between the vibration phases of the housing panel and the housing back panel is between −20° and 20°. More preferably, the difference between the vibration phases of the housing panel and the housing back panel is between −15° and 15°. More preferably, the difference between the vibration phases of the housing panel and the housing back panel is between −12° and 12°. More preferably, the difference between the vibration phases of the housing panel and the housing back panel is between −10° and 10°. More preferably, the difference between the vibration phases of the housing panel and the housing back panel is between −8° and 8°. More preferably, the difference between the vibration phases of the housing panel and the housing back panel is between −6 and 6°. More preferably, the difference between the vibration phases of the housing panel and the housing back panel is between −5° and 5°. More preferably, the difference between the vibration phases of the housing panel and the housing back panel is between −4° and 4°. More preferably, the difference between the vibration phases of the housing panel and the housing back panel is between −3° and 3°. More preferably, the difference between the vibration phases of the housing panel and the housing back panel is between −2° and 2°. More preferably, the difference between the vibration phases of the housing panel and the housing back panel is between −1° and 1°. More preferably, the difference between the vibration phases of the housing panel and the housing back panel is 0°.

It should be noted that the illustration of the bone conduction speaker is only a specific example and should not be regarded as the only feasible implementation. Obviously, for those skilled in the art, after understanding the basic principle of the bone conduction speaker, it may be possible to make various modifications and changes in the forms and details of the specific methods and operations of implementing the bone conduction speaker without departing from the principles, but these modifications and changes are still within the scope of the present disclosure. For example, the housing side panel, the housing back panel, and the housing bracket may be an integral structure. Such deformations are all within the protection scope of the present disclosure.

Figure 15:
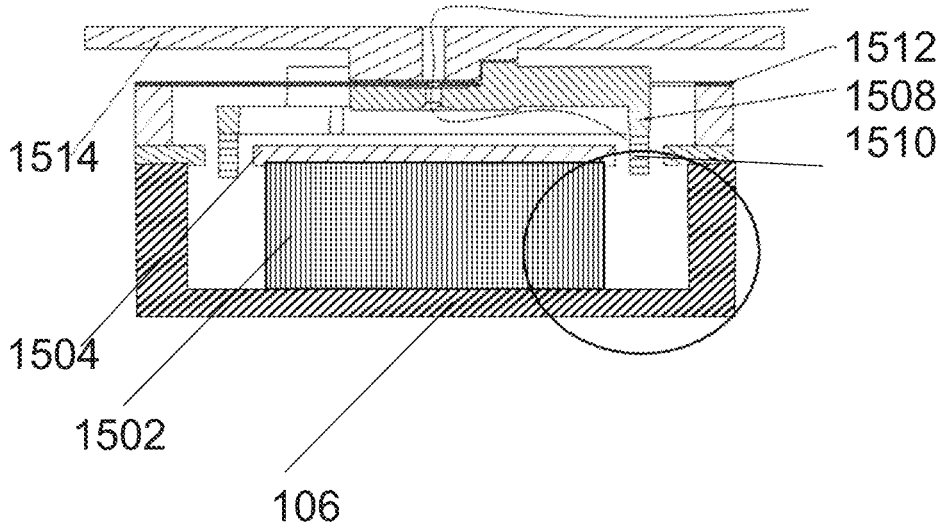
FIG. 15 is a structural diagram illustrating a speaker according to some embodiments of the present disclosure.

FIG. 15 is a longitudinal sectional view illustrating a loudspeaker apparatus according to some embodiments of the present disclosure. As shown in FIG. 15, the speaker may include a first magnetic unit 1502, a first magnetically conductive unit 1504, a second magnetically conductive unit 1506, a first vibration plate 1508, a voice coil 1510, a second vibration plate 1512, and a vibration panel 1514. As used herein, some units of the earphone core of the loudspeaker apparatus may correspond to the magnetic circuit component. In some embodiments, the magnetic circuit component may include the first magnetic unit 1502, the first magnetically conductive unit 1504, and the second magnetically conductive unit 1506. The magnetic circuit component may generate a first full magnetic field (also referred to "total magnetic field of the magnetic circuit component" or "first magnetic field").

The magnetic unit described in the present disclosure may refer to a unit that may generate a magnetic field, such as a magnet. The magnetic unit may have a magnetization direction. The magnetization direction may refer to a direction of a magnetic field inside the magnetic unit. In some embodiments, the first magnetic unit 302 may include one or more magnets. The first magnetic unit may generate a second magnetic field. In some embodiments, the magnet may include a metal alloy magnet, ferrite, or the like. The metal alloy magnet may include neodymium iron boron, samarium cobalt, aluminum nickel cobalt, iron chromium cobalt, aluminum iron boron, iron carbon aluminum, or the like, or any combination thereof. Ferrite may include barium ferrite, steel ferrite, manganese ferrite, lithium manganese ferrite, or the like, or any combination thereof.

In some embodiments, a lower surface of the first magnetically conductive unit 1504 may be connected to an upper surface of the first magnetic unit 1502. The second magnetically conductive unit 1506 may be connected to the first magnetic unit 1502. It should be noted that the magnetically conductive unit herein may also refer to a magnetic field concentrator or an iron core. The magnetically conductive unit may adjust a distribution of a magnetic field (e.g., a second magnetic field generated by the first magnetic unit 1502). The magnetically conductive unit may include a unit made of a soft magnetic material. In some embodiments, the soft magnetic material may include metal materials, metal alloys, metal oxide materials, amorphous metal materials, etc., such as iron, iron-silicon alloys, iron-aluminum alloys, nickel-iron alloys, iron-cobalt series alloys, low carbon steel, silicon steel sheet, silicon steel sheet, ferrite, etc. In some embodiments, the magnetically conductive unit may be processed by casting, plastic processing, cutting processing, powder metallurgy, or the like, or any combination thereof. The casting may include sand casting, investment casting, pressure casting, centrifugal casting, etc. The plastic processing may include rolling, casting, forging, stamping, extrusion, drawing, or the like, or any combination thereof. The cutting processing may include turning, milling, planing, grinding, or the like. In some embodiments, the processing method of the magnetically conductive unit may include 3D printing, CNC machine tools, or the like. A connection manner between the first magnetically conductive unit 1504, the second magnetically conductive unit 1506, and the first magnetic unit 1502 may include bonding, snapping, welding, riveting, bolting, or the like, or any combination thereof. In some embodiments, the first magnetic unit 1502, the first magnetically conductive unit 1504, and the second magnetically conductive unit 1506 may be disposed as an axisymmetric structure. The axisymmetric structure may be a ring structure, a columnar structure, or other axisymmetric structures.

In some embodiments, a magnetic gap may form between the first magnetic unit 1502 and the second magnetically conductive unit 1506. The voice coil 1510 may be disposed in the magnetic gap. The voice coil 1510 may be connected to the first vibration plate 1508. The first vibration plate 1508 may be connected to the second vibration plate 1512. The second vibration plate 1512 may be connected to the vibration panel 1514. When a current is passed into the voice coil 1510, the voice coil 1510 may be located in a magnetic field formed by the first magnetic unit 1502, the first magnetically conductive unit 1504, and the second magnetically conductive unit 1506, and applied to an ampere force. The ampere force may drive the voice coil 1510 to vibrate, and the vibration of the voice coil 1510 may drive the vibration of the first vibration plate 1508, the second vibration plate 1512, and the vibration panel 1514. The vibration panel 1514 may transmit the vibration to auditory nerves through tissues and bones, so that a person may hear a sound. The vibration panel 1514 may be in direct contact with human skins, or contact with the skins through a vibration transmission layer made of a specific material.

In some embodiments, for a loudspeaker apparatus with a single magnetic unit, magnetic induction line(s) passing through the voice coil may not be uniform and divergent. At the same time, magnetic leakage may form in the magnetic circuit. That is, more magnetic induction lines may leak outside the magnetic gap and fail to pass through the voice coil. As a result, a magnetic induction strength (or magnetic field strength) at the position of the voice coil may decrease, which may affect the sensitivity of the loudspeaker apparatus. Therefore, the loudspeaker apparatus may further include at least one second magnetic unit and/or at least one third magnetically conductive unit (not shown in figures). The at least one second magnetic unit and/or at least one third magnetically conductive unit may suppress the leakage of the magnetic induction lines and restrict the shape of the magnetic induction lines passing through the voice coil. Therefore, more magnetic induction lines may pass through the voice coil as horizontally and densely as possible to increase the magnetic induction strength (or magnetic field strength) at the position of the voice coil, thereby increasing the sensitivity of the loudspeaker apparatus, and further improving the mechanical conversion efficiency of the loudspeaker apparatus (i.e., the efficiency of converting the input power of the loudspeaker apparatus into the mechanical energy of the vibration of the voice coil).

Figure 16:
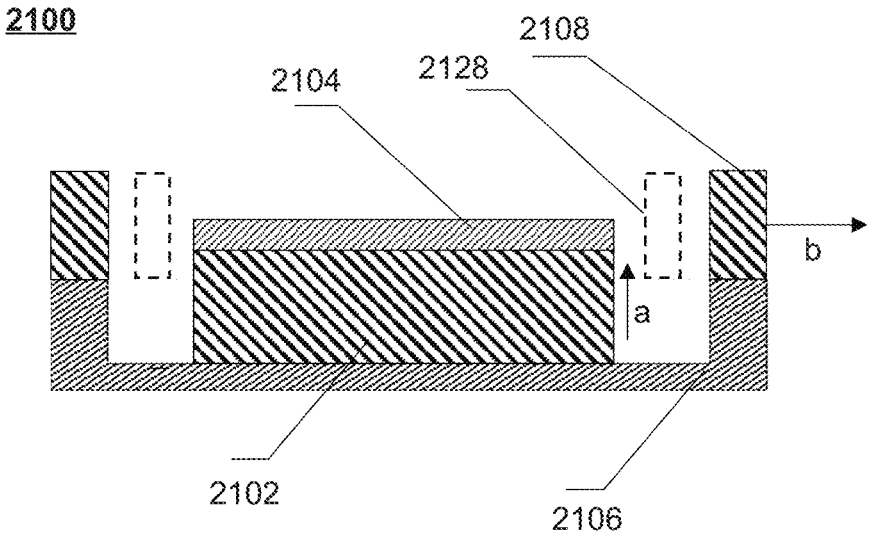
FIG. 16 is a longitudinal sectional view illustrating a magnetic circuit component 2100 according to some embodiments of the present disclosure.

FIG. 16 is a longitudinal sectional view illustrating a magnetic circuit component 2100 according to some embodiments of the present disclosure. As shown in FIG. 16, the magnetic circuit component 2100 may include a first magnetic unit 2102, a first magnetically conductive unit 2104, a second magnetically conductive unit 2106, and a second magnetic unit 2108. In some embodiments, the first magnetic unit 2102 and/or the second magnetic unit 2108 may include any one or more magnets described in the present disclosure. In some embodiments, the first magnetic unit 2102 may include a first magnet, and the second magnetic unit 2108 may include a second magnet. The first magnet may be the same as or different from the second magnet. The first magnetically conductive unit 2104 and/or the second magnetically conductive unit 2106 may include any one or more magnetically conductive materials described in the present disclosure. The processing manner of the first magnetically conductive unit 2104 and/or the second magnetically conductive unit 2106 may include any one or more processing manners described in the present disclosure. In some embodiments, the first magnetic unit 2102 and/or the first magnetically conductive unit 2104 may be disposed as an axisymmetric structure. For example, the first magnetic unit 2102 and/or the first magnetically conductive unit 2104 may be a cylinder, a cuboid, or a hollow ring (e.g., the cross-section is a shape of the runway). In some embodiments, the first magnetic unit 2102 and the first magnetically conductive unit 2104 may be coaxial cylinders with the same or different diameters. In some embodiments, the second magnetically conductive unit 2106 may be a groove-type structure. The groove-type structure may include a U-shaped section (as shown in FIG. 15). The groove-type second magnetically conductive unit 2106 may include a bottom plate and a side wall. In some embodiments, the bottom plate and the side wall may be integrally formed as a whole. For example, the side wall may be formed by extending the bottom plate in a direction perpendicular to the bottom plate. In some embodiments, the bottom plate may be connected to the side wall through any one or more connection manners described in the present disclosure. The second magnetic unit 2108 may be disposed as a ring shape or a sheet shape. In some embodiments, the second magnetic unit 2108 may be the ring shape. The second magnetic unit 2108 may include an inner ring and an outer ring. In some embodiments, the shape of the inner ring and/or the outer ring may be a ring, an ellipse, a triangle, a quadrangle, or any other polygons. In some embodiments, the second magnetic unit 2108 may be formed by arranging a number of magnets. Both ends of any one of the number of magnets may be connected to or have a certain distance from both ends of an adjacent magnet. The spacing between the magnets may be the same or different. In some embodiments, the second magnetic unit 2108 may be formed by arranging two or three sheet-shaped magnets equidistantly. The shape of the sheet-shaped magnet may be fan-shaped, a quadrangular shape, or the like. In some embodiments, the second magnetic unit 2108 may be coaxial with the first magnetic unit 2102 and/or the first magnetically conductive unit 2104.

In some embodiments, the upper surface of the first magnetic unit 2102 may be connected to the lower surface of the first magnetically conductive unit 2104. The lower surface of the first magnetic unit 2102 may be connected to the bottom plate of the second magnetically conductive unit 306. The lower surface of the second magnetic unit 2108 may be connected to the side wall of the second magnetically conductive unit 2106. The connection manners between the first magnetic unit 2102, the first magnetically conductive unit 2104, the second magnetically conductive unit 2106, and/or the second magnetic unit 2108 may include bonding, snapping, welding, riveting, bolting, or the like, or any combination thereof.

In some embodiments, a magnetic gap may be formed between the first magnetic unit 2102 and/or the first magnetically conductive unit 2104 and the inner ring of the second magnetic unit 2108. A voice coil 2128 may be disposed in the magnetic gap. In some embodiments, heights of the second magnetic unit 2108 and the voice coil 2128 relative to the bottom plate of the second magnetically conductive unit 2106 may be equal. In some embodiments, the first magnetic unit 2102, the first magnetically conductive unit 2104, the second magnetically conductive unit 2106, and the second magnetic unit 2108 may forma magnetic circuit. In some embodiments, the magnetic circuit component 2100 may generate a first full magnetic field (also referred to "total magnetic field of magnetic circuit component" or "first magnetic field"). The first magnetic unit 2102 may generate a second magnetic field. The first full magnetic field may be formed by magnetic fields generated by all components (e.g., the first magnetic unit 2102, the first magnetically conductive unit 2104, the second magnetically conductive unit 2106, and the second magnetic unit 2108) in the magnetic circuit component 2100. The magnetic field strength of the first full magnetic field in the magnetic gap (also referred to as magnetic induction strength or magnetic flux density) may be greater than the magnetic field strength of the second magnetic field in the magnetic gap. In some embodiments, the second magnetic unit 2108 may generate a third magnetic field. The third magnetic field may increase the magnetic field strength of the first full magnetic field in the magnetic gap. The third magnetic field increasing the magnetic field strength of the first full magnetic field herein may mean that the magnetic strength of the first full magnetic field in the magnetic gap when the third magnetic field exists (i.e., the second magnetic unit 2108 exists) may be greater than that of the first full magnetic field when the third magnetic field does not exist (i.e., the second magnetic unit 2108 does not exist). In other embodiments of the specification, unless otherwise specified, the magnetic circuit component may mean a structure including all magnetic units and magnetically conductive units. The first full magnetic field may represent the magnetic field generated by the magnetic circuit component as a whole. The second magnetic field, the third magnetic field, . . . , and the N-th magnetic field may respectively represent the magnetic fields generated by the corresponding magnetic units. In different embodiments, the magnetic unit that generates the second magnetic field (the third magnetic field, . . . , or the N-th magnetic field) may be the same or different.

In some embodiments, an included angle between a magnetization direction of the first magnetic unit 2102 and a magnetization direction of the second magnetic unit 2108 may be between 0 degrees and 180 degrees. In some embodiments, the included angle between the magnetization direction of the first magnetic unit 2102 and the magnetization direction of the second magnetic unit 2108 may be between 45 degrees and 135 degrees. In some embodiments, the induced angle between the magnetization direction of the first magnetic unit 2102 and the magnetization direction of the second magnetic unit 2108 may be equal to or greater than 90 degrees. In some embodiments, the magnetization direction of the first magnetic unit 2102 may be perpendicular to the lower surface or the upper surface of the first magnetic unit 302 and be vertically upward (as shown by the direction a in the figure). The magnetization direction of the second magnetic unit 2108 may be directed from the inner ring of the second magnetic unit 2108 to the outer ring (as shown by the direction b on the right side of the first magnetic unit 2102 in the figure, the magnetization direction of the first magnetic unit 2102 may deflect 90 degrees in a clockwise direction).

In some embodiments, at the position of the second magnetic unit 2108, an included angle between the direction of the first full magnetic field and the magnetization direction of the second magnetic unit 2108 may not be greater than 90 degrees. In some embodiments, at the position of the second magnetic unit 2108, the included angle between the direction of the magnetic field generated by the first magnetic unit 2102 and the direction of the magnetization of the second magnetic unit 2108 may be less than or equal to 90 degrees, such as 0 degrees, 10 degrees, 20 degrees, or the like.

Compared with a magnetic circuit component with a single magnetic unit, the second magnetic unit 2108 may increase the total magnetic flux in the magnetic gap of the magnetic circuit component 2100, thereby increasing the magnetic induction intensity in the magnetic gap. And, under the action of the second magnetic unit 2108, originally scattered magnetic induction lines may converge to the position of the magnetic gap, further increasing the magnetic induction intensity in the magnetic gap.

Figure 17:
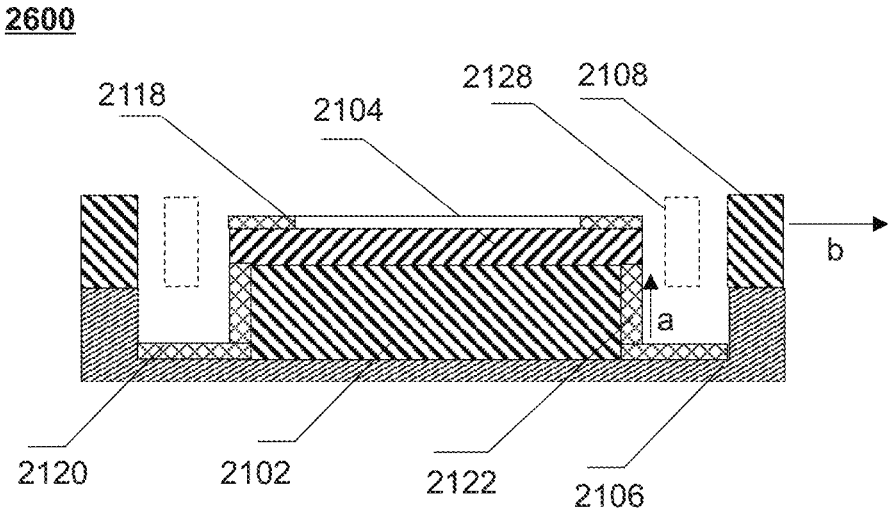
FIG. 17 is a longitudinal sectional view illustrating a magnetic circuit component 2600 according to some embodiments of the present disclosure.

FIG. 17 is a longitudinal sectional view illustrating a magnetic circuit component 2600 according to some embodiments of the present disclosure. As shown in FIG. 17, different from the magnetic circuit component 2100, the magnetic circuit component 2600 may further include at least one electrically conductive unit (e.g., a first electrically conductive unit 2118, a second electrically conductive unit 2120, and a third electrically conductive unit 2122).

The electrically conductive unit may include a metal material, a metal alloy material, an inorganic non-metal material, or other conductive materials. The metal material may include gold, silver, copper, aluminum, etc. The metal alloy material may include an iron-based alloy, an aluminum-based alloy material, a copper-based alloys, a zinc-based alloys, etc. The inorganic non-metal material may include graphite, etc. The electrically conductive unit may be a sheet shape, a ring shape, a mesh shape, or the like. The first electrically conductive unit 2118 may be disposed on an upper surface of the first magnetically conductive unit 2104. The second electrically conductive unit 2120 may be connected to the first magnetic unit 2102 and the second magnetically conductive unit 2106. The third electrically conductive unit 2122 may be connected to a side wall of the first magnetic unit 2102. In some embodiments, the first magnetically conductive unit 2104 may protrude from the first magnetic unit 2102 to form a first concave portion. The third electrically conductive unit 2122 may be disposed on the first concave portion. In some embodiments, the first electrically conductive unit 2118, the second electrically conductive unit 2120, and the third electrically conductive unit 2122 may include the same or different conductive materials. The first electrically conductive unit 2118, the second electrically conductive unit 2120, and the third electrically conductive unit 2122 may be respectively connected to the first magnetically conductive unit 2104, the second magnetically conductive unit 2106 and/or the first magnetic unit 2102 through any one or more connection manners described in the present disclosure.

A magnetic gap may be formed between the first magnetic unit 2102, the first magnetically conductive unit 2104, and the inner ring of the second magnetic unit 2108. A voice coil 2128 may be disposed in the magnetic gap. The first magnetic unit 2102, the first magnetically conductive unit 2104, the second magnetically conductive unit 2106, and the second magnetic unit 2108 may form a magnetic circuit. In some embodiments, the electrically conductive unit may reduce an inductive reactance of the voice coil 2128. For example, if a first alternating current flows through the voice coil 2128, a first alternating induced magnetic field may be generated near the voice coil 2128. Under the action of the magnetic field in the magnetic circuit, the first alternating induced magnetic field may cause the inductive reactance of the voice coil 2128 and hinder the movement of the voice coil 2128. When an electrically conductive unit (e.g., the first electrically conductive unit 2118, the second electrically conductive unit 2120, and the third electrically conductive unit 2122) is disposed near the voice coil 2128, the electrically conductive unit may induce a second alternating current under the action of the first alternating induced magnetic field. A third alternating current in the electrically conductive unit may generate a second alternating induced magnetic field near the third alternating current. The second alternating induction magnetic field may be opposite to the first alternating induction magnetic field, and weaken the first alternating induction magnetic field, thereby reducing the inductive reactance of the voice coil 2128, increasing the current in the voice coil, and improving the sensitivity of the speaker.

Figure 18:
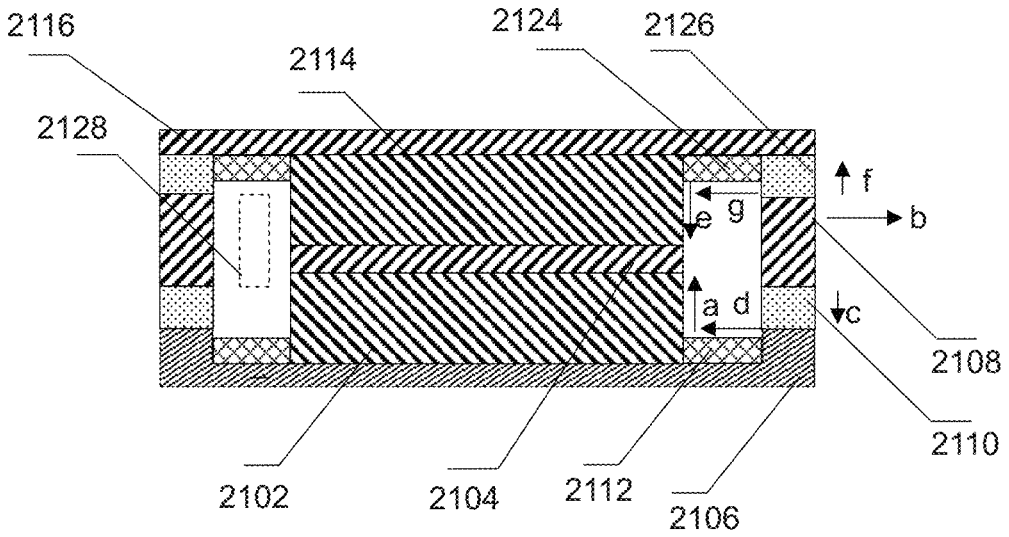
FIG. 18 is a longitudinal sectional view illustrating a magnetic circuit component 2700 according to some embodiments of the present disclosure.

FIG. 18 is a longitudinal sectional view illustrating a magnetic circuit component 2700 according to some embodiments of the present disclosure. As shown in FIG. 18, different from the magnetic circuit component 2500, the magnetic circuit component 2700 may further include a third magnetic unit 2110, a fourth magnetic unit 2112, a fifth magnetic unit 2114, a third magnetically conductive unit 2116, a sixth magnetic unit 2124, and a seventh magnetic unit 2126. The third magnetic unit 2110, the fourth magnetic unit 2112, the fifth magnetic unit 2114, the third magnetically conductive unit 2116 and/or the sixth magnetic unit 2124, and the seventh magnetic unit 2126 may be disposed as coaxial ring cylinders.

In some embodiments, an upper surface of the second magnetic unit 2108 may be connected to the seventh magnetic unit 2126. A lower surface of the second magnetic unit 2108 may be connected to the third magnetic unit 2110. The third magnetic unit 2110 may be connected to the second magnetically conductive unit 2106. An upper surface of the seventh magnetic unit 2126 may be connected to the third magnetically conductive unit 2116. The fourth magnetic unit 2112 may be connected to the second magnetically conductive unit 2106 and the first magnetic unit 2102. The sixth magnetic unit 2124 may be connected to the fifth magnetic unit 2114, the third magnetically conductive unit 2116, and the seventh magnetic unit 2126. In some embodiments, the first magnetic unit 2102, the first magnetically conductive unit 2104, the sixth magnetic unit 2124, the second magnetically conductive unit 2106, the second magnetic unit 2108, the third magnetic unit 2110, the fourth magnetic unit 2112, the fifth magnetic unit 2114, the third magnetically conductive unit 2116, and the seventh magnetic unit 2126 may form a magnetic circuit and a magnetic gap.

In some embodiments, an included angle between a magnetization direction of the first magnetic unit 2102 and a magnetization direction of the sixth magnetic unit 2124 may be between 0 degrees and 180 degrees. In some embodiments, the included angle between the magnetization direction of the first magnetic unit 2102 and the magnetization direction of the sixth magnetic unit 2124 may be between 45 degrees and 135 degrees. In some embodiments, the included angle between the magnetization direction of the first magnetic unit 2102 and the magnetization direction of the sixth magnetic unit 2124 may not be higher than 90 degrees. In some embodiments, the magnetization direction of the first magnetic unit 2102 may be perpendicular to a lower surface or an upper surface of the first magnetic unit 2102 and be vertically upward (as shown by the direction a in the figure). The magnetization direction of the sixth magnetic unit 2124 may be directed from an outer ring of the sixth magnetic unit 2124 to an inner ring (as shown by the direction g on the right side of the first magnetic unit 2102 in the figure, the magnetization direction of the first magnetic unit 2102 may deflect 270 degrees in a clockwise direction). In some embodiments, the magnetization direction of the sixth magnetic unit 2124 may be the same as that of the fourth magnetic unit 2112 in the same vertical direction.

In some embodiments, at the position of the sixth magnetic unit 2124, an included angle between the direction of the magnetic field generated by the magnetic circuit component 2700 and the magnetization direction of the sixth magnetic unit 2124 may not be higher than 90 degrees. In some embodiments, at the position of the sixth magnetic unit 2124, the included angle between the direction of the magnetic field generated by the first magnetic unit 2102 and the magnetized direction of the sixth magnetic unit 2124 may be less than or equal to 90 degrees, such as 0 degrees, 10 degrees, or 20 degrees.

In some embodiments, the included angle between the magnetization direction of the first magnetic unit 2102 and the magnetization direction of the seventh magnetic unit 2126 may be between 0 degrees and 180 degrees. In some embodiments, the included angle between the magnetization direction of the first magnetic unit 2102 and the magnetization direction of the seventh magnetic unit 2126 may be between 45 degrees and 135 degrees. In some embodiments, the included angle between the magnetization direction of the first magnetic unit 2102 and the magnetization direction of the seventh magnetic unit 2126 may not be higher than 90 degrees. In some embodiments, the magnetization direction of the first magnetic unit 2102 may be perpendicular to a lower surface or an upper surface of the first magnetic unit 2102 and be vertically upward (as shown by the direction a in the figure). The magnetization direction of the seventh magnetic unit 2126 may be directed from the lower surface of the seventh magnetic unit 2126 to the upper surface (as shown in the direction f on the right side of the first magnetic unit 2102 in the figure, the magnetization direction of the first magnetic unit 2102 may deflect 360 degrees in a clockwise direction). In some embodiments, the magnetization direction of the seventh magnetic unit 2126 may be opposite to that of the third magnetic unit 2110.

In some embodiments, at the position of the seventh magnetic unit 2126, the included angle between the direction of the magnetic field generated by magnetic circuit component 2700 and the direction of magnetization of the seventh magnetic unit 2126 may not be higher than 90 degrees. In some embodiments, at the position of the seventh magnetic unit 2126, the included angle between the direction of the magnetic field generated by the first magnetic unit 2102 and the magnetized direction of the seventh magnetic unit 2126 may be less than or equal to 90 degrees, such as 0 degrees, 10 degrees, or 20 degrees.

In the magnetic circuit component 2700, the third magnetically conductive unit 2116 may close the magnetic circuit generated by the magnetic circuit component 2700, so that more magnetic induction lines may be concentrated in the magnetic gap, thereby implementing the effect of suppressing the magnetic leakage, increasing the magnetic induction strength in the magnetic gap, and improving the sensitivity of the loudspeaker apparatus.

Figure 19:
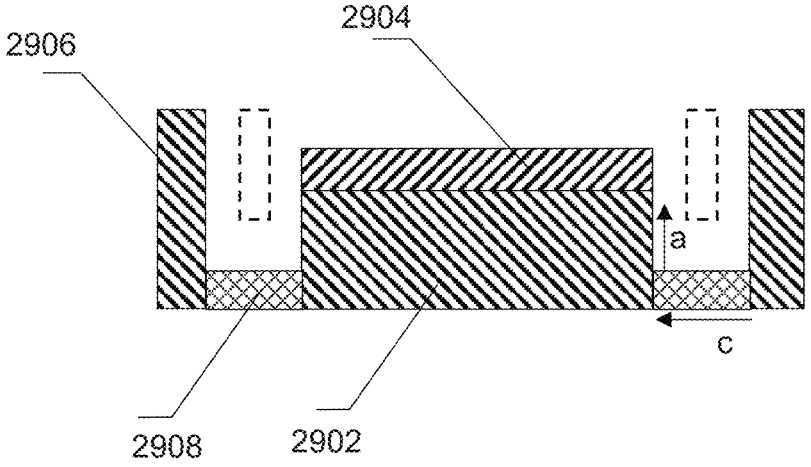
FIG. 19 is a longitudinal sectional view illustrating a magnetic circuit component 2900 according to some embodiments of the present disclosure.

FIG. 19 is a longitudinal sectional view illustrating a magnetic circuit component 2900 according to some embodiments of the present disclosure. As shown in FIG. 19, the magnetic circuit component 2900 may include a first magnetic unit 2902, a first magnetically conductive unit 2904, a first full magnetic field changing unit 2906, and a second magnetic unit 2908.

An upper surface of the first magnetic unit 2902 may be connected to a lower surface of the first magnetically conductive unit 2904. The second magnetic unit 2908 may be connected to the first magnetic unit 2902 and the first full magnetic field changing unit 2906. The connection manners between the first magnetic unit 2902, the first magnetically conductive unit 2904, the first full magnetic field changing unit 2906, and/or the second magnetic unit 2908 may be based on any one or more connection manners described in the present disclosure. In some embodiments, the first magnetic unit 2902, the first magnetically conductive unit 2904, the first full magnetic field changing unit 2906, and/or the second magnetic unit 2908 may form a magnetic circuit and a magnetic gap.

In some embodiments, the magnetic circuit component 2900 may generate a first full magnetic field. The first magnetic unit 2902 may generate a second magnetic field. A magnetic field intensity of the first full magnetic field in the magnetic gap may be greater than the magnetic field intensity of the second magnetic field in the magnetic gap. In some embodiments, the second magnetic unit 2908 may generate a third magnetic field. The third magnetic field may increase a magnetic field strength of the second magnetic field in the magnetic gap.

In some embodiments, the included angle between the magnetization direction of the first magnetic unit 2902 and the magnetization direction of the second magnetic unit 2908 may be between 0 degrees and 180 degrees. In some embodiments, the included angle between the magnetization direction of the first magnetic unit 2902 and the magnetization direction of the second magnetic unit 2908 may be between 45 degrees and 135 degrees. In some embodiments, the included angle between the magnetization direction of the first magnetic unit 2902 and the magnetization direction of the second magnetic unit 2908 may not be higher than 90 degrees.

In some embodiments, at the position of the second magnetic unit 2908, the included angle between a direction of the first full magnetic field and the magnetization direction of the second magnetic unit 2908 may not be higher than 90 degrees. In some embodiments, at the position of the second magnetic unit 2908, the included angle between the direction of the magnetic field generated by the first magnetic unit 2902 and the direction of magnetization of the second magnetic unit 2908 may be a less than or equal to 90 degrees, such as 0 degrees, 10 degrees, or 20 degrees. As another example, the magnetization direction of the first magnetic unit 2902 may be perpendicular to the lower surface or the upper surface of the first magnetic unit 2902 and be vertically upward (as shown by the direction a in the figure). The magnetization direction of the second magnetic unit 2908 may be directed from the outer ring of the second magnetic unit 2908 to the inner ring (as shown by the direction c on the right side of the first magnetic unit 2902 in the figure, the magnetization direction of the first magnetic unit 2902 may deflect 270 degrees in a clockwise direction).

Compared with a magnetic circuit component with a single magnetic unit, the first full magnetic field changing unit 2906 in the magnetic circuit component 2900 may increase the total magnetic flux in the magnetic gap, thereby increasing the magnetic induction intensity in the magnetic gap. And, under the action of the first full magnetic field changing unit 2906, originally scattered magnetic induction lines may converge to the position of the magnetic gap, further increasing the magnetic induction intensity in the magnetic gap.

Figure 20:
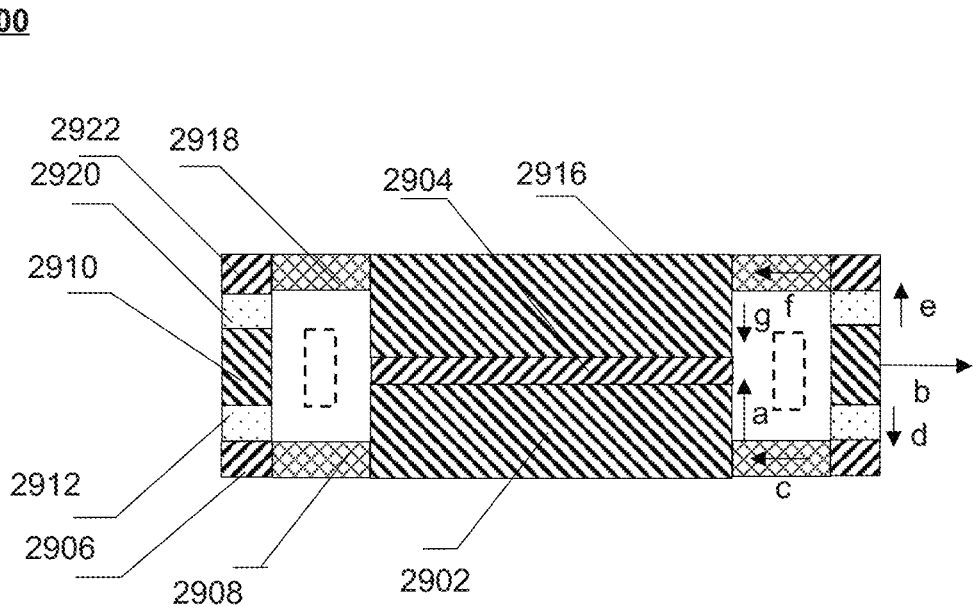
FIG. 20 is a longitudinal sectional view illustrating a magnetic circuit component 3000 according to some embodiments of the present disclosure.

FIG. 20 is a longitudinal sectional view illustrating a magnetic circuit component 3000 according to some embodiments of the present disclosure. As shown in FIG. 20, in some embodiments, the magnetic circuit component 3000 may include the first magnetic unit 2902, a first magnetically conductive unit 2904, a first full magnetic field changing unit 2906, a second magnetic unit 2908, a third magnetic unit 2910, a fourth magnetic unit 2912, a fifth magnetic unit 2916, a sixth magnetic unit 2918, a seventh magnetic unit 2920, and a second ring unit 2922. In some embodiments, the first full magnetic field changing unit 2906 and/or the second ring unit 2922 may include a ring-shaped magnetic unit or a ring-shaped magnetically conductive unit. The ring-shaped magnetic unit may include any one or more magnetic materials described in the present disclosure. The ring-shaped magnetically conductive unit may include any one or more magnetically conductive materials described in the present disclosure.

In some embodiments, the sixth magnetic unit 2918 may be connected to the fifth magnetic unit 2916 and the second ring unit 2922. The seventh magnetic unit 2920 may be connected to the third magnetic unit 2910 and the second ring unit 2922. In some embodiments, the first magnetic unit 2902, the fifth magnetic unit 2916, the second magnetic unit 2908, the third magnetic unit 2910, the fourth magnetic unit 2912, the sixth magnetic unit 2918, and/or the seventh magnetic unit 2920, the first magnetically conductive unit 2904, the first full magnetic field changing unit 2906, and the second ring unit 2922 may form a magnetic circuit.

In some embodiments, an included angle between the magnetization direction of the first magnetic unit 2902 and a magnetization direction of the sixth magnetic unit 2918 may be between 0 degrees and 180 degrees. In some embodiments, the angle between the magnetization direction of the first magnetic unit 2902 and the magnetization direction of the sixth magnetic unit 2918 may be between 45 degrees and 135 degrees. In some embodiments, the included angle between the magnetization direction of the first magnetic unit 2902 and the magnetization direction of the sixth magnetic unit 2918 may not be higher than 90 degrees. In some embodiments, the magnetization direction of the first magnetic unit 2902 may be perpendicular to the lower surface or the upper surface of the first magnetic unit 2902 and be vertically upward (as shown by the direction a in the figure). The magnetization direction of the sixth magnetic unit 2918 may be directed from an outer ring of the sixth magnetic unit 2918 to an inner ring (as shown by the direction f on a right side of the first magnetic unit 2902 in the figure, the magnetization direction of the first magnetic unit 2902 may deflect 270 degrees in a clockwise direction). In some embodiments, in the same vertical direction, the magnetization direction of the sixth magnetic unit 2918 may be the same as that of the second magnetic unit 2908. In some embodiments, the magnetization direction of the first magnetic unit 2902 may be perpendicular to the lower surface or the upper surface of the first magnetic unit 2902 and be vertically upward (as shown by the direction a in the figure). The magnetization direction of the seventh magnetic unit 2920 may be directed from the lower surface of the seventh magnetic unit 2920 to the upper surface (as shown by the direction e on the right side of the first magnetic unit 2902 in the figure, the magnetization direction of the first magnetic unit 2902 may deflect 360 degrees in the clockwise direction). In some embodiments, a magnetization direction of the seventh magnetic unit 2920 may be the same as that of the fourth magnetic unit 2912.

In some embodiments, at a position of the sixth magnetic unit 2918, an included angle between a direction of a magnetic field generated by the magnetic circuit component 2900 and the magnetization direction of the sixth magnetic unit 2918 may not be higher than 90 degrees. In some embodiments, at the position of the sixth magnetic unit 2918, the included angle between the direction of the magnetic field generated by the first magnetic unit 2902 and the direction of magnetization of the sixth magnetic unit 2918 may be less than or equal to 90 degrees, such as 0 degrees, 10 degrees, or 20 degrees.

In some embodiments, an included angle between the magnetization direction of the first magnetic unit 2902 and the magnetization direction of the seventh magnetic unit 2920 may be between 0 degrees and 180 degrees. In some embodiments, the included angle between the magnetization direction of the first magnetic unit 2902 and the magnetization direction of the seventh magnetic unit 2920 may be between 45 degrees and 135 degrees. In some embodiments, the included angle between the magnetization direction of the first magnetic unit 2902 and the magnetization direction of the seventh magnetic unit 2920 may not be higher than 90 degrees.

In some embodiments, at a position of the seventh magnetic unit 2920, an included angle between a direction of a magnetic field generated by the magnetic circuit component 3000 and the magnetization direction of the seventh magnetic unit 2920 may not be higher than 90 degrees. In some embodiments, at the position of the seventh magnetic unit 2920, the included angle between the direction of the magnetic field generated by the first magnetic unit 2902 and the direction of magnetization of the seventh magnetic unit 2920 may be less than or equal to 90 degrees, such as 0 degrees, 10 degrees, or 20 degrees.

In some embodiments, the first full magnetic field changing unit 2906 may be a ring-shaped magnetic unit. In such cases, a magnetization direction of the first full magnetic field changing unit 2906 may be the same as that of the second magnetic unit 2908 or the fourth magnetic unit 2912. For example, on the right side of the first magnetic unit 2902, the magnetization direction of the first full magnetic field changing unit 2906 may be directed from an outer ring to an inner ring of the first full magnetic field changing unit 2906. In some embodiments, the second ring unit 2922 may be a ring-shaped magnetic unit. In such cases, a magnetization direction of the second ring unit 2922 may be the same as that of the sixth magnetic unit 2918 or the seventh magnetic unit 2920. For example, on the right side of the first magnetic unit 2902, the magnetization direction of the second ring unit 2922 may be directed from an outer ring to an inner ring of the second ring unit 2922.

In the magnetic circuit component 3000, a number of magnetic units may increase the total magnetic flux. Different magnetic units may interact with each other, thereby suppressing the leakage of the magnetic induction lines, increasing the magnetic induction strength in the magnetic gap, and improving the sensitivity of the loudspeaker apparatus.

Figure 21:
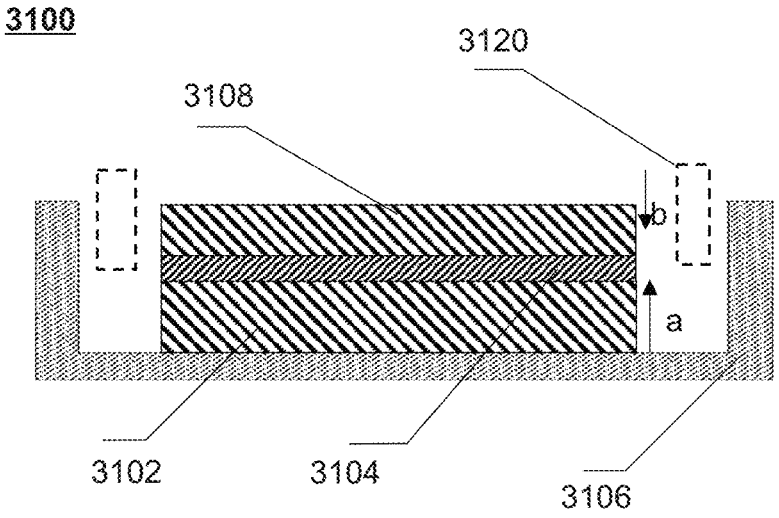
FIG. 21 is a longitudinal sectional schematic diagram illustrating a magnetic circuit component 3100 according to some embodiments of the present disclosure.

FIG. 21 is a longitudinal sectional view illustrating a magnetic circuit component 3100 according to some embodiments of the present disclosure. As shown in FIG. 21, the magnetic circuit component 3100 may include a first magnetic unit 3102, a first magnetically conductive unit 3104, a second magnetically conductive unit 3106, and a second magnetic unit 3108.

In some embodiments, the first magnetic unit 3102 and/or the second magnetic unit 3108 may include any one or more of the magnets described in the present disclosure. In some embodiments, the first magnetic unit 3102 may include a first magnet. The second magnetic unit 3108 may include a second magnet. The first magnet may be the same as or different from the second magnet. The first magnetically conductive unit 3104 and/or the second magnetically conductive unit 3106 may include any one or more magnetically conductive materials described in the present disclosure. The processing manner of the first magnetically conductive unit 3104 and/or the second magnetically conductive unit 3106 may include any one or more processing manners described in the present disclosure. In some embodiments, the first magnetic unit 3102, the first magnetically conductive unit 3104, and/or the second magnetic unit 3108 may be disposed as an axisymmetric structure. For example, the first magnetic unit 3102, the first magnetically conductive unit 3104, and/or the second magnetic unit 3108 may be cylinders. In some embodiments, the first magnetic unit 3102, the first magnetically conductive unit 3104, and/or the second magnetic unit 3108 may be coaxial cylinders with the same diameter or different diameters. The thickness of the first magnetic unit 3102 may be greater than or equal to the thickness of the second magnetic unit 3108. In some embodiments, the second magnetically conductive unit 3106 may be a groove-type structure. The groove-type structure may include a U-shaped section. The groove-type second magnetically conductive unit 3106 may include a bottom plate and a side wall. In some embodiments, the bottom plate and the side wall may be integrally formed as a whole. For example, the side wall may be formed by extending the bottom plate in a direction perpendicular to the bottom plate. In some embodiments, the bottom plate may be connected to the side wall through any one or more connection manners described in the present disclosure. The second magnetic unit 3108 may be disposed as a ring shape or a sheet shape. The shape of the second magnetic unit 3108 may refer to descriptions elsewhere in the specification. In some embodiments, the second magnetic unit 3108 may be coaxial with the first magnetic unit 3102 and/or the first magnetically conductive unit 3104.

An upper surface of the first magnetic unit 3102 may be connected to a lower surface of the first magnetically conductive unit 3104. A lower surface of the first magnetic unit 3102 may be connected to the bottom plate of the second magnetically conductive unit 3106. A lower surface of the second magnetic unit 3108 may be connected to an upper surface of the first magnetically conductive unit 3104. A connection manner between the first magnetic unit 3102, the first magnetically conductive unit 3104, the second magnetically conductive unit 3106 and/or the second magnetic unit 3108 may include one or more manners such as bonding, snapping, welding, riveting, bolting, or the like, or any combination thereof.

A magnetic gap may be formed between the first magnetic unit 3102, the first magnetically conductive unit 3104, and/or the second magnetic unit 3108 and the side wall of the second magnetically conductive unit 3106. A voice coil may be disposed in the magnetic gap. In some embodiments, the first magnetic unit 3102, the first magnetically conductive unit 3104, the second magnetically conductive unit 3106, and the second magnetic unit 3108 may form a magnetic circuit. In some embodiments, the magnetic circuit component 3100 may generate a first full magnetic field. The first magnetic unit 3102 may generate a second magnetic field. The first full magnetic field may be formed by magnetic fields generated by all components (e.g., the first magnetic unit 3102, the first magnetically conductive unit 3104, the second magnetically conductive unit 3106, and the second magnetic unit 3108) in the magnetic circuit component 3100. A magnetic field strength of the first full magnetic field in the magnetic gap (also referred to magnetic induction strength or magnetic flux density) may be greater than a magnetic field strength of the second magnetic field in the magnetic gap. In some embodiments, the second magnetic unit 3108 may generate a third magnetic field. The third magnetic field may increase the magnetic field strength of the second magnetic field in the magnetic gap.

In some embodiments, an included angle between a magnetization direction of the second magnetic unit 3108 and a magnetization direction of the first magnetic unit 3102 may be between 90 degrees and 180 degrees. In some embodiments, the included angle between the magnetization direction of the second magnetic unit 3108 and the magnetization direction of the first magnetic unit 3102 may be between 150 degrees and 180 degrees. In some embodiments, the magnetization direction of the second magnetic unit 3108 may be opposite to that of the first magnetic unit 3102 (the direction a and the direction b shown in the figure).

Compared with a magnetic circuit component with a single magnetic unit, the magnetic circuit component 3100 may add the second magnetic unit 3108. The magnetization direction of the second magnetic unit 3108 may be opposite to the magnetization direction of the first magnetic unit 3102, which may suppress a magnetic leakage of the first magnetic unit 3102 in the magnetization direction. Therefore, the magnetic field generated by the first magnetic unit 3102 may be more compressed into the magnetic gap, thereby increasing the magnetic induction strength within the magnetic gap.

It should be noted that the description of the loudspeaker apparatus described above is merely for illustration purposes and should not be regarded as the only feasible implementation solution. Obviously, for those skilled in the art, after understanding the basic principle of the loudspeaker apparatus, it may be possible to make various modifications and changes in forms and details of the specific methods and operations of implementing the loudspeaker apparatus without departing from the principles, but these modifications and changes are still within the scope described above. For example, the magnetic unit in the magnetic circuit component is not limited to the first magnetic unit, the second magnetic unit, the third magnetic unit, the fourth magnetic unit, the fifth magnetic unit, the sixth magnetic unit, and the seventh magnetic unit. The number of magnetic units may be increased or decreased. Such deformations are all within the protection scope of the present disclosure.

Figure 22:
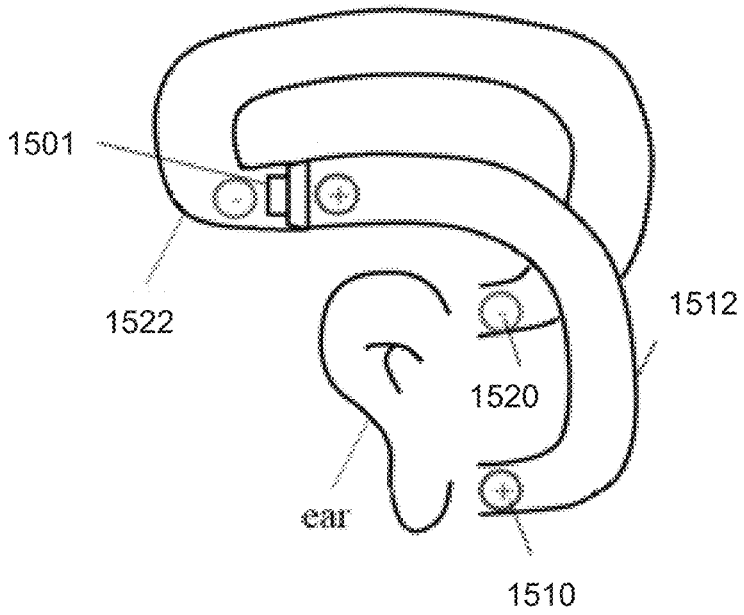
FIG. 22 is a schematic diagram illustrating transmitting a sound through air conduction according to some embodiments of the present disclosure.

In some embodiments, the loudspeaker apparatus (e.g., MP3 Player) described above may also transmit the sound to the user through air conduction. When the air condition is used to transmit the sound, the loudspeaker apparatus may include one or more sound sources. The sound source may be located at a specific position of the user's head, for example, the top of the head, a forehead, a cheek, a temple, an auricle, the back of an auricle, etc., without blocking or covering an ear canal. FIG. 22 is a schematic diagram illustrating transmitting a sound through air conduction according to some embodiments of the present disclosure.

As shown in FIG. 22, a sound source 1510 and a sound source 1520 may generate sound waves with opposite phases ("+" and "–" in the figure indicate the opposite phases). For brevity, the sound source mentioned herein may refer to sound outlets of the loudspeaker apparatus that may output sounds. For example, the sound source 1510 and the sound source 1520 may be two sound outlets respectively located at specific positions of the loudspeaker apparatus (for example, the core housing 20, or the circuit housing 30).

In some embodiments, the sound source 1510 and the sound source 1520 may be generated by the same vibration device 1501. The vibration device 1501 may include a diaphragm (not shown in the figure). When the diaphragm is driven to vibrate by an electric signal, the front side of the diaphragm may drive the air to vibrate, the sound source 1510 may be formed at the sound outlet through a sound guiding channel 1512, the back of the diaphragm may drive air to vibrate, and the sound source 1520 may be formed at the sound outlet through a sound guiding channel 1522. The sound guiding channel may refer to a sound transmission route from the diaphragm to the corresponding sound outlet. In some embodiments, the sound guiding channel may be a route surrounded by a specific structure on the loudspeaker apparatus (for example, the core housing 20, or the circuit housing 30). It should be known that, in some alternative embodiments, the sound source 1510 and the sound source

1520 may also be generated by different vibrating diaphragms of different vibration devices, respectively.

Among the sounds generated by the sound source 1510 and the sound source 1520, one portion may be transmitted to the ear of the user to form the sound heard by the user. Another portion may be transmitted to the environment to form a leaked sound. Considering that the sound source 1510 and the sound source 1520 are relatively close to the ears of the user, for convenience of description, the sound transmitted to the ears of the user may be referred to as a near-field sound. The leaked sound transmitted to the environment may be referred to as a far-field sound. In some embodiments, the near-field/far-field sounds of different frequencies generated by the loudspeaker apparatus may be related to a distance between the sound source 1510 and the sound source 1520. Generally speaking, the near-field sound generated by the loudspeaker apparatus may increase as the distance between the two sound sources increases, while the generated far-field sound (the leaked sound) may increase with the increasing of the frequency.

For the sounds of different frequencies, the distance between the sound source 1510 and the sound source 1520 may be designed, respectively, so that a low-frequency near-field sound (e.g., a sound with a frequency of less than 800 Hz) generated by the loudspeaker apparatus may be as large as possible and a high-frequency far-field sound (e.g., a sound with a frequency greater than 2000 Hz) may be as small as possible. In order to implement the above purpose, the loudspeaker apparatus may include two or more sets of dual sound sources. Each set of the dual sound sources may include two sound sources similar to the sound source 1510 and the sound source 1520, and generate sounds with specific frequencies, respectively. Specifically, a first set of the dual sound sources may be used to generate low frequency sounds. A second set of the dual sound sources may be used to generate high frequency sounds. In order to obtain more low-frequency near-field sounds, the distance between two sound sources in the first set of the dual sound sources may be set to a larger value. Since the low-frequency signal has a longer wavelength, the larger distance between the two sound sources may not cause a large phase difference in the far-field, and not form excessive leaked sound in the far-field. In order to make the high-frequency far-field sound smaller, the distance between the two sound sources in the second set of the dual sound sources may be set to a smaller value. Since the high-frequency signal has a shorter wavelength, the smaller distance between the two sound sources may avoid the generation of the large phase difference in the far-field, and thus the generation of the excessive leaked sounds may be avoided. The distance between the second set of the dual sound sources may be less than the distance between the first set of the dual sound sources.

The beneficial effects of the embodiments of the present disclosure may include but be not limited to: (1) the protective sleeve of the ear hook may elastically abut against the core housing, thereby improving the waterproof performance of the loudspeaker apparatus; (2) the size of the forming mold may be reduced by using different molds to form the ear hook and the core housing separately, thereby reducing the difficulty of mold processing and forming the ear hook and the core housing during production; (3) by increasing the overall rigidity of the housing, the housing panel and the housing back panel may vibrate with the same or substantially the same amplitude and phase at higher frequencies, thereby reducing the sound leakage of the loudspeaker apparatus; (4) the sensitivity of the loudspeaker apparatus may be improved by adding a magnetic unit, a magnetically conductive unit and an electrically conductive unit in the magnetic circuit components. It should be noted that different embodiments may have different beneficial effects. In different embodiments, the possible beneficial effects may be any one or a combination of the above, and may be any other beneficial effects that may be obtained.

The basic concepts have been described above. Obviously, for persons having ordinary skills in the art, the disclosure of the invention is merely by way of example, and does not constitute a limitation on the present disclosure. Although not explicitly stated here, those skilled in the art may make various modifications, improvements, and amendments to the present disclosure. These alterations, improvements, and modifications are intended to be suggested by this disclosure and are within the spirit and scope of the exemplary embodiments of this disclosure.

What is claimed is:

1. A loudspeaker apparatus, comprising:

an ear hook including a first plug end and a second plug end, the ear hook being surrounded by a protective sleeve, the protective sleeve being made of an elastic waterproof material;

a core housing for accommodating an earphone core, the core housing being fixed to the first plug end and elastically abutted against the protective sleeve, wherein the core housing including a housing panel facing human body and a housing back panel opposite to the housing panel, and the vibration of the earphone core drives the housing panel and the housing back panel to vibrate, the vibration of the housing panel having a first phase, the vibration of the housing back panel having a second phase, wherein when the vibration frequencies of the housing panel and the housing back panel is within a range of 2000 Hz to 3000 Hz, an absolute value of a difference between the first phase and the second phase is less than 60 degrees; and a circuit housing for accommodating a control circuit or a battery, the circuit housing being fixed to the second plug end, the control circuit or the battery driving the earphone core to vibrate to generate a sound.

2. The loudspeaker apparatus of claim 1, wherein the ear hook further includes:

an elastic metal wire;

a wire; and a fixed sleeve, the fixed sleeve fixing the wire on the elastic metal wire, the protective sleeve being formed, by injection molding, on periphery of the elastic metal wire, the wire, the fixed sleeve, the first plug end, and the second plug end.

3. The loudspeaker apparatus of claim 2, wherein the first plug end and the second plug end are formed, by injection molding, at both ends of the elastic metal wire respectively, the first plug end and the second plug end are arranged with a first wiring channel and a second wiring channel respectively, and the wire extends along the first wiring channel and the second wiring channel.

4. The loudspeaker apparatus of claim 3, wherein the wire passes through the first wiring channel and the second wiring channel.

5. The loudspeaker apparatus of claim 3, wherein the first wiring channel includes a first wiring groove and a first wiring hole connecting the first wiring groove and an outer end surface of the first plug end, the wire extends along the first wiring groove and the first wiring hole and is exposed on the outer end surface of the first plug end, the second wiring channel includes a second wiring groove and a second wiring hole connecting the second wiring groove and the outer end surface of the first plug end, and the wire extends along the second wiring groove and the second wiring hole and is exposed on the outer end surface of the second plug end.

6. The loudspeaker apparatus of claim 2, wherein the ear hook includes at least two fixed sleeves spaced apart along the elastic metal wire.

7. The loudspeaker apparatus of claim 1, wherein the core housing is arranged with a first socket connecting with an outer end surface of the core housing, a stopping block is arranged on an inner sidewall of the first socket, and the first socket is connected to the first plug end.

8. The loudspeaker apparatus of claim 7, wherein the first plug end includes:

an inserting portion being at least partially inserted into the first socket and abutting against an outer side surface of the stopping block; and two elastic hooks being arranged on a side of the inserting portion facing inside of the core housing, wherein:

the two elastic hooks are brought together under action of external thrust and the stopping block, and after passing through the stopping block, the two elastic hooks are elastically restored to be stuck on an inner surface of the stopping block to realize the fixation of the core housing and the first plug end.

9. The loudspeaker apparatus of claim 8, wherein the inserting portion is partially inserted into the first socket, and an exposed part of the inserting portion is arranged in a stepped manner to form an annular table surface spaced apart from the outer end surface of the core housing.

10. The loudspeaker apparatus of claim 9, wherein the protective sleeve further extends to a side of the annular table surface facing the outer end surface of the core housing, and when the core housing and the first plug end are fixed, the protective sleeve elastically abuts against the core housing to realize sealing.

11. The loudspeaker apparatus of claim 1, wherein the loudspeaker apparatus further includes a fastener, the circuit housing is arranged with a second socket, and the second plug end is at least partially inserted into the second socket and connected to the second socket by the fastener.

12. The loudspeaker apparatus of claim 11, wherein the second plug end is arranged with a slot perpendicular to an inserting direction of the second socket, a through hole corresponding to a position of the slot is arranged on a first sidewall of the circuit housing;

the fastener includes two parallel pins and a connecting portion for connecting the pins, and the pins are inserted into the slot from outside of the circuit housing through the through hole to realize the plug and fixation of the circuit housing and the second plug end.

13. The loudspeaker apparatus of claim 1, wherein the ear hook further includes a housing sheath integrally formed with the protective sleeve, the housing sheath being wrapped around periphery of the circuit housing.

14. The loudspeaker apparatus of claim 1, wherein the vibration signal of the housing panel has a first amplitude, the vibration signal of the housing back panel has a second amplitude, and a ratio of the first amplitude to the second amplitude is within a range of 0.5 to 1.5.

15. The loudspeaker apparatus of claim 1, wherein the vibration of the housing panel generates a first leaked sound wave, the vibration of the housing back panel generates a second leaked sound wave, wherein the first leaked sound wave and the second leaked sound wave are superimposed on each other, which reduces an amplitude of the first leaked sound wave.

16. The loudspeaker apparatus of claim 1, wherein the earphone core further includes a magnetic circuit component generating a first magnetic field, the magnetic circuit component including:

a first magnetic unit configured to generate a second magnetic field;

a first magnetically conductive unit; and at least one second magnetic unit, the at least one second magnetic unit surrounding the first magnetic unit and forming a magnetic gap with the first magnetic unit, a magnetic field strength of the first magnetic field in the magnetic gap being greater than a magnetic field strength of the second magnetic field in the magnetic gap.

17. The loudspeaker apparatus of claim 16, wherein the magnetic circuit component further includes:

a second magnetically conductive unit; and at least one third magnetic unit being connected to the second magnetically conductive unit and the at least one second magnetic unit.

18. The loudspeaker apparatus of claim 17, wherein the magnetic circuit component further includes:

at least one fourth magnetic unit being located below the magnetic gap and connected to the first magnetic unit and the second magnetically conductive unit.

19. The loudspeaker apparatus of claim 17, wherein the first magnetically conductive unit is connected to the upper surface of the first magnetic unit, the second magnetically conductive unit includes a bottom plate and a sidewall; and the first magnetic unit is connected to the bottom plate of the second magnetically conductive unit.

20. The loudspeaker apparatus of claim 17, further comprising:

at least one electrically conductive unit being connected to at least one unit of the first magnetic unit, the first magnetically conductive unit, or the second magnetically conductive unit.

* * * * *